US010711807B2

(12) United States Patent
Whiteside et al.

(10) Patent No.: US 10,711,807 B2
(45) Date of Patent: Jul. 14, 2020

(54) GAS LIFT PUMP APPARATUS WITH ULTRASONIC ENERGY GENERATOR AND METHOD

(75) Inventors: Richard Eric Whiteside, Alfreton (GB); David Benjamin Redgate, Alfreton (GB); Tobias Mark Wells, Alfreton (GB)

(73) Assignee: COLDHARBOUR MARINE LIMITED, Linby, Nottinghamshire (GB)

( * ) Notice: Subject to any disclaimer, the term of this patent is extended or adjusted under 35 U.S.C. 154(b) by 676 days.

(21) Appl. No.: 13/805,874

(22) PCT Filed: Jun. 29, 2011

(86) PCT No.: PCT/GB2011/051235

§ 371 (c)(1),
(2), (4) Date: Dec. 20, 2012

(87) PCT Pub. No.: WO2012/001415

PCT Pub. Date: Jan. 5, 2012

(65) Prior Publication Data

US 2013/0160688 A1 Jun. 27, 2013

(30) Foreign Application Priority Data

Jun. 29, 2010 (GB) ..... 1010907.2
Sep. 4, 2010 (GB) ..... 1014681.9
Oct. 20, 2010 (GB) ..... 1017715.2

(51) Int. Cl.
*F04F 7/00* (2006.01)
*F04F 1/18* (2006.01)
(Continued)

(52) U.S. Cl.
CPC ..... *F04F 7/00* (2013.01); *B08B 9/0326* (2013.01); *F04F 1/18* (2013.01); *F04F 1/20* (2013.01)

(58) Field of Classification Search
None
See application file for complete search history.

(56) References Cited

U.S. PATENT DOCUMENTS 347,196 A 8/1886 Pohle
1,054,629 A 2/1913 Warwick
(Continued)

FOREIGN PATENT DOCUMENTS

CN 87100504 A 8/1987
CN 101792692 A 8/2010
(Continued)

OTHER PUBLICATIONS

Munding, Machine Translation of DE19700202, 1998, 15 total pages.*

(Continued)

*Primary Examiner* — Jonathan M Peo
(74) *Attorney, Agent, or Firm* — Myers Bigel, P.A.

(57) ABSTRACT

A gas lift pump apparatus for treating ballast water includes a column through which a liquid medium, such as seawater, may be pumped by gas lift. The apparatus includes a delivery device for delivering a flow of a gas into the liquid medium, and a resonance chamber that generates ultrasonic energy therein by the flow of the gas therethrough. The apparatus is operable to launch the ultrasonic energy into the liquid medium in the column.

12 Claims, 17 Drawing Sheets

(51) Int. Cl.
*F04F 1/20* (2006.01)
*B08B 9/032* (2006.01)

(56) References Cited

U.S. PATENT DOCUMENTS

| | | | | |
|---|---|---|---|---|
| 1,604,419 | A | 6/1923 | Oliphant | |
| 1,698,619 | A | 1/1929 | Blow | |
| 1,712,695 | A | 5/1929 | Engstrand | |
| 2,632,513 | A | 3/1953 | Bennett | |
| 3,172,370 | A | 3/1965 | Hoff | |
| 3,230,923 | A * | 1/1966 | Hughes | G10K 5/00 116/137 A |
| 3,393,519 | A | 7/1968 | Mitchell | |
| 3,427,989 | A | 2/1969 | Bostock et al. | |
| 3,433,174 | A | 3/1969 | Chenoweth | |
| 3,694,106 | A | 9/1972 | Walker | |
| 4,408,719 | A | 10/1983 | Last | |
| 5,326,468 | A * | 7/1994 | Cox | B01F 5/0646 138/45 |
| 5,735,600 | A | 4/1998 | Wyness et al. | |
| 6,221,260 | B1 * | 4/2001 | Chahine | A61L 2/02 210/175 |
| 6,402,965 | B1 | 6/2002 | Sullivan et al. | |
| 6,540,922 | B1 | 4/2003 | Cordemans et al. | |
| 6,770,248 | B2 * | 8/2004 | Haggett | A61L 2/025 134/184 |
| 6,821,442 | B1 | 11/2004 | Watten | |
| 2002/0174814 | A1 | 11/2002 | Hunter | |
| 2003/0132165 | A1 | 7/2003 | De Meulenaer et al. | |
| 2005/0006313 | A1 * | 1/2005 | Swinnen | C02F 1/36 210/748.03 |
| 2006/0118495 | A1 * | 6/2006 | Kondratalv | C02F 1/34 210/748.03 |
| 2009/0145595 | A1 | 6/2009 | Mazzanti | |
| 2010/0224571 | A1 * | 9/2010 | Babaev | C02F 1/36 210/748.03 |
| 2011/0306931 | A1 | 12/2011 | Kamen et al. | |

FOREIGN PATENT DOCUMENTS

| | | | |
|---|---|---|---|
| DE | 40 37 899 | A1 | 6/1992 |
| DE | 197 00 202 | A1 | 7/1998 |
| DE | 10 2004 042984 | A1 | 3/2006 |
| EP | 0232000 | A1 | 8/1987 |
| EP | 0442454 | A1 | 8/1991 |
| EP | 0 963 784 | A1 | 12/1999 |
| FR | 2 809 179 | A1 | 11/2001 |
| GB | 150698 | | 8/1919 |
| GB | 624385 | A | 6/1949 |
| GB | 1063388 | | 8/1964 |
| GB | 1063860 | A | 3/1967 |
| GB | 1241377 | | 5/1969 |
| GB | 2470070 | A | 10/2010 |
| JP | S50125718 | A | 10/1975 |
| JP | S5489366 | A | 7/1979 |
| JP | 56114897 | | 9/1981 |
| JP | S60227887 | | 11/1985 |
| JP | S6245398 | A | 2/1987 |
| JP | 1310200 | A | 12/1989 |
| JP | 2090982 | A | 3/1990 |
| JP | H0426100 | U | 3/1992 |
| JP | H04026100 | U | 3/1992 |
| JP | H06134347 | A | 5/1994 |
| JP | H06277690 | A | 10/1994 |
| JP | 2000000447 | A | 1/2000 |
| JP | 2000205200 | A | 7/2000 |
| JP | 2000240600 | A | 9/2000 |
| JP | 2000516522 | A | 12/2000 |
| JP | 2003049800 | A | 2/2003 |
| JP | 2004237144 | A | 8/2004 |
| JP | 2005291171 | A | 10/2005 |
| JP | 2006043674 | A | 2/2006 |
| JP | 2006136819 | | 6/2006 |
| JP | 2007 113295 | A | 5/2007 |
| JP | 2007515289 | A | 6/2007 |
| JP | 2007229577 | A | 9/2007 |
| JP | 2008520473 | A | 6/2008 |
| JP | 2009022941 | A | 2/2009 |
| JP | 2009056442 | A | 3/2009 |
| JP | 2009513333 | A | 4/2009 |
| JP | 2009-131827 | A | 6/2009 |
| JP | 2010000490 | A | 1/2010 |
| JP | 2010036148 | A | 2/2010 |
| JP | 2011072982 | A | 4/2011 |
| RU | 2248469 | C1 | 3/2005 |
| SU | 500379 | A1 | 1/1976 |
| WO | WO 2005/005322 | A | 1/2005 |
| WO | WO 2005/061394 | A1 | 7/2005 |
| WO | WO 2006/080969 | A1 | 8/2006 |
| WO | WO 2007/049139 | A1 | 5/2007 |
| WO | WO 2007049139 | A2 * | 5/2007 ..... B63B 13/00 |
| WO | WO 2010/128336 | A1 | 11/2010 |
| WO | WO 2012/001415 | A1 | 1/2012 |

OTHER PUBLICATIONS

Mebes, "Machine Translation of CH637034", published 1983, 7 total pages.*

Patents Act 1977: Examination Report under Section 18(3), UK IPO Application No. GB1411447.4, dated Aug. 2, 2017, 5 pp.

* cited by examiner

GAS LIFT PUMP APPARATUS WITH ULTRASONIC ENERGY GENERATOR AND METHOD

RELATED APPLICATIONS

This application is a 35 U.S.C. § 371 national stage application of PCT Application No. PCT/GB2011/051235, filed on 29 Jun. 2011, which claims priority from Great Britain Patent Application No. 1010907.2, filed 29 Jun. 2010, from Great Britain Patent Application No. 1014681.9, filed 4 Sep. 2010, and from Great Britain Patent Application No. 1017715.2, filed 20 Oct. 2010, the contents of which are incorporated herein by reference in their entireties. The above-referenced PCT International Application was published in the English language as International Publication No. WO 2012/001415 A9 on 5 Jan. 2012.

FIELD OF THE INVENTION

The present invention relates to an ultrasonic energy generation device and to a method of delivering ultrasonic energy. In particular but not exclusively the invention relates to an ultrasonic energy generation device for delivering a flow of fluid into a gas lift pump apparatus.

BACKGROUND

It is known to provide a gas lift pump for pumping a fluid such as a liquid or sludge. JP2007113295 discloses an air lift pump for excavating sediment and sludge that has deposited and hardened on a sub-aqueous bottom over a period of time. The pump has a riser pipe whose lower end header reaches as far as the sub-aqueous bottom; a nozzle which is enclosed by the header and sprays high-pressure fluid, and a blade for scraping material from the sub-aqueous bottom.

JP1207535 discloses an air lift pump for pumping mud from a water bottom such as a river bed.

In an entirely separate technical field, the problem exists that aquatic nuisance species (ANS) such as Zebra mussels are being transported between locations such as between the US and Asia in the ballast tanks of maritime vessels. Aquatic nuisance species may be defined as waterborne, non-native organisms that threaten the diversity or abundance of native species, the ecological stability of impacted waters or commercial, agricultural, aquacultural or recreational activities. A variety of measures for preventing invasion of an environment by ANS have been proposed, including purging of ballast tanks at sea before a vessel enters an area sensitive to ANS.

However, purging of a ballast tank requires emptying and refilling of the ballast tank. It will be understood that such a procedure can have an adverse effect on the stability of a vessel particularly in rough seas and is not appropriate in certain cases.

It is also known to kill ANS by pumping inert gas into seawater. The inert gas can for example be supplied by or derived from the combustion gases of a marine engine such as a diesel engine.

STATEMENT OF THE INVENTION

Embodiments of the present invention may be understood with reference to the appended claims.

In an aspect of the invention there is provided gas lift pump apparatus comprising a column through which a liquid medium may be pumped by gas lift, the apparatus comprising a fluid delivery device for delivering a flow of a gaseous fluid into the liquid medium, the device comprising means for generating ultrasonic energy by the flow of gaseous fluid therethrough, the device being operable to launch the ultrasonic energy into the liquid medium in the column.

In one aspect of the invention there is provided a fluid delivery device for delivering a flow of a gaseous fluid into a liquid medium, the device comprising means for generating ultrasonic energy under the flow of gaseous fluid therethrough, the device being operable to launch the ultrasonic energy into the liquid medium.

Embodiments of the invention have the advantage that a gaseous fluid may be delivered into a liquid in a ballast tank of a vessel in order to kill aquatic nuisance species by exposure of the species to the ultrasonic energy.

Furthermore, embodiments of the invention allow a concentration of the gaseous fluid in the liquid medium to be increased whilst at the same time generating the ultrasonic energy. This allows the apparatus to be employed to kill aquatic nuisance species (ANS) both by increasing the concentration of the gaseous fluid in the liquid medium and by means of passage of the ultrasonic energy through the liquid medium.

In some applications the ultrasonic energy is arranged to kill bacteria present in the liquid medium, such as one or more of toxicogenic *Vibrio cholerae, Escherichia coli* (*E. coli*) and intestinal enterococci.

Some embodiments of the invention employ an arrangement similar to that of a Hartmann whistle in order to generate ultrasonic energy.

Preferably the device comprises a resonance chamber, the device being operable to excite the resonance chamber at a resonant frequency of the apparatus due to flow of the gaseous fluid through the device thereby to launch the ultrasonic energy.

Preferably the resonance chamber comprises a receptor member, the receptor member being arranged to reflect a pressure wave generated by passage of the gaseous fluid through the device thereby to generate the ultrasonic energy.

The receptor member may be provided by at least a portion of a wall of the resonance chamber.

Alternatively or in addition the receptor member may be provided by a member within the resonance chamber.

Preferably the device is operable to cause the gaseous fluid to pass into the resonance chamber thereby to excite the resonance chamber.

Preferably the device is operable wherein gaseous fluid entering the resonance chamber impinges upon the receptor member.

The receptor member preferably comprises a cupped portion, the device being arranged to direct a flow of gaseous fluid into the cupped portion of the receptor member, the receptor member being arranged in turn to redirect the flow of gaseous fluid out from the cupped portion.

Preferably, the device is arranged wherein impingement of gaseous fluid on the receptor member causes heating of the receptor member.

The device maybe operable wherein heating of the receptor member causes heating of the liquid medium.

Preferably the receptor member is provided in thermal communication with a surface of the device in thermal communication with the liquid medium.

The device preferably comprises a nozzle member, the nozzle member being arranged to deliver the flow of gaseous fluid into the resonance chamber.

The device is preferably operable to cause a pressure standing wave to be established in the resonance chamber. Preferably the pressure standing wave is an ultrasonic standing wave.

Preferably the resonant frequency of the device may be operably changed from a first value to a second value.

Preferably the resonant frequency of the device may be operably changed by changing a position of the receptor member.

Optionally the resonant frequency of the device may be operably changed by changing a position of the receptor member with respect to the nozzle member.

The resonance chamber may comprise a fluid outlet, the device being arranged wherein gaseous fluid flowing through the resonance chamber may exit the resonance chamber through the fluid outlet.

The device may be provided with amplification means for increasing an amplitude of the ultrasonic energy launched into the medium.

The amplification means may comprise means for reducing a mismatch between an impedance of the device and an impedance of the liquid medium.

The amplification means may comprise an amplification chamber, the amplification chamber being acoustically coupled to the device.

The amplification chamber may comprise a gas filled chamber.

The amplification chamber may have a cross-sectional area that increases as a function of distance from the device.

The amplification chamber may have a substantially tapered cross-section.

The amplification chamber preferably has a substantially conical shape.

The amplification chamber may have a substantially frusto-conical shape.

At least one wall of the chamber may comprise a resiliently flexible membrane arranged to transmit at least a portion of the ultrasonic energy into the liquid medium.

The resiliently flexible membrane may comprise one selected from amongst a metallic membrane and a polymer membrane.

Preferably the device is arranged to be provided in a flow-stream of the liquid medium, the device having an upstream portion and a downstream portion.

The upstream portion and/or the downstream portion may be tapered thereby to reduce an amount of drag experienced by the device in the flow-stream of the liquid medium.

Preferably the upstream portion comprises the receptor member.

The gaseous fluid is preferably an inert gas.

The device is preferably operable to kill at least one aquatic nuisance species by means of the ultrasonic energy launched by the device.

The device may be arranged whereby an aperture by means of which gaseous fluid passes from the device into the liquid medium is arranged to generate an ultrasonic wave by passage of the gaseous fluid therethrough.

In a further aspect of the invention there is provided gas lift pump apparatus comprising a column through which liquid is pumped by gas lift, the apparatus comprising a fluid delivery device according to the first aspect.

Gaseous fluid flowing through the device may be arranged to pass into the column of the gas lift pump apparatus thereby to cause pumping of the liquid medium.

Preferably pumping of the liquid medium by the gaseous fluid occurs by gas lift.

The fluid delivery device may be provided in a flowpath of fluid through the column.

Alternatively the device may be provided at a location that is recessed radially outwardly with respect to an inner wall of the column. For example the device may be provided at a location that is displaced radially outwardly with respect to the inner wall so that it does not lie in a direct flowpath of fluid through the column. In some arrangements the device may be at least partially recessed with respect to the wall of the column.

The column may be of a substantially circular cross-section or any other suitable cross-sectional shape such as elliptical, square or any other suitable shape.

Preferably the apparatus is operable to kill ANS present in the liquid by means of the ultrasonic energy generated by the device.

Preferably the apparatus further comprises a microbubble generator.

Preferably the microbubble generator is arranged to generate microbubbles upstream of the device.

The microbubble generator may comprise a venturi portion, the venturi portion having a converging section, a throat section and a diverging section.

The apparatus may be arranged to generate a flow of liquid into the venturi in the form of a vortex thereby to generate microbubbles in the liquid.

The apparatus is preferably arranged to generate a flow of liquid into the venturi in the form of a vortex by injecting a flow of liquid into the column of the apparatus.

The apparatus may be arranged to generate a flow of liquid into the venturi in the form of a vortex by injecting a flow of liquid into the column of the apparatus in a direction substantially tangential to the column.

The microbubbles may have a diameter in the range of at least one selected from amongst from around 1 micron to around 1000 microns, around 1 micron to around 500 microns, around 1 micron to around 100 microns, around 1 micron to around 10 microns and around 10 microns to around 100 microns.

The column may have one or more apertures in a sidewall thereof to allow flow of liquid that is pumped by the apparatus to flow therethrough.

This has the advantage that circulation of liquid in a volume of water in which the apparatus is provided may be enhanced.

Advantageously the column has a plurality of apertures formed in the sidewall thereof.

An end of the column downstream of the flow of liquid may be closed thereby to force liquid flowing through the column to flow out from the column through the apertures.

In a still further aspect of the invention there is provided a method of delivering gaseous fluid into a liquid medium comprising the steps of: providing a flow of a gaseous fluid through a fluid delivery device, the device being arranged wherein the flow of gaseous fluid through the device causes the device to launch ultrasonic energy into the gaseous fluid.

Preferably the gaseous fluid is selected whereby increasing a concentration of the gaseous fluid in the liquid medium to a sufficiently high value results in death of at least one ANS present in the liquid medium.

The gaseous fluid may comprise an inert gas.

The gaseous fluid may comprise at least one selected from amongst carbon dioxide, nitrogen and oxygen.

The gaseous fluid may substantially comprise carbon dioxide, nitrogen and oxygen.

The gaseous fluid may consist essentially of carbon dioxide, nitrogen and oxygen.

Alternatively the gaseous fluid may be carbon dioxide.

The gaseous fluid may comprise one or more combustion gases.

Preferably the liquid medium is ballast water of a vessel.

More preferably the liquid medium is ballast water in a ballast tank of a vessel.

Preferably, the method comprises generating ultrasonic energy by passage of gaseous fluid through an aperture from the device into the liquid medium.

The method may further comprise producing microbubbles in the liquid medium and launching the ultrasonic energy into the liquid medium containing the microbubbles.

The method preferably comprises trapping ANS present in the liquid medium in or on a microbubble.

Preferably the method further comprises killing the ANS by means of the ultrasonic energy.

In another aspect of the invention there is provided a method of killing aquatic nuisance species comprising the steps of: providing a flow of a gaseous fluid through a fluid delivery device, the device being arranged wherein the flow of gaseous fluid through the device causes the device to launch ultrasonic energy into the liquid medium thereby to kill aquatic nuisance species therein.

In an aspect of the invention there is provided a liquid storage tank comprising a device according to the first aspect.

In one aspect of the invention there is provided a ballast tank for a marine vessel comprising a device according to the first aspect.

In a further aspect of the invention there is provided a vessel having a ballast tank comprising a device according to the first aspect.

In a still further aspect of the invention there is provided a liquid storage tank comprising apparatus according to the second aspect of the invention.

In another aspect of the invention there is provided a ballast tank for a marine vessel comprising apparatus according to the second aspect of the invention.

In a further aspect of the invention there is provided a vessel having a ballast tank comprising apparatus according to the second aspect of the invention.

In one embodiment there is provided a fluid delivery device for delivering a flow of a gaseous fluid into a liquid medium, the device being operable wherein the flow of gaseous fluid through the device causes the device to launch ultrasonic energy into the liquid medium.

It is to be understood that some embodiments of the invention provide a Hartmann-type whistle structure to launch the ultrasonic energy into a liquid medium. In addition, some embodiments of the invention are arranged to inject gas flowing through the whistle structure into the liquid medium.

Some embodiments of the invention are employed in combination with a gas lift pump to cause pumping or recirculation of liquid in a tank such as a ballast tank of a vessel.

Some embodiments of the invention are arranged to kill ANS and in particular bacterial and/or viral or similar ANS by means of the ultrasonic energy. Other arrangements are also useful.

In addition, in some embodiments the whistle is arranged to have a gas passed therethrough that is arranged to kill one or more ANS, for example by hypoxia and/or hypercapnia.

BRIEF DESCRIPTION OF THE DRAWINGS

Embodiments of the invention will now be described with reference to the accompanying figures in which.

DETAILED DESCRIPTION

Figure 1:
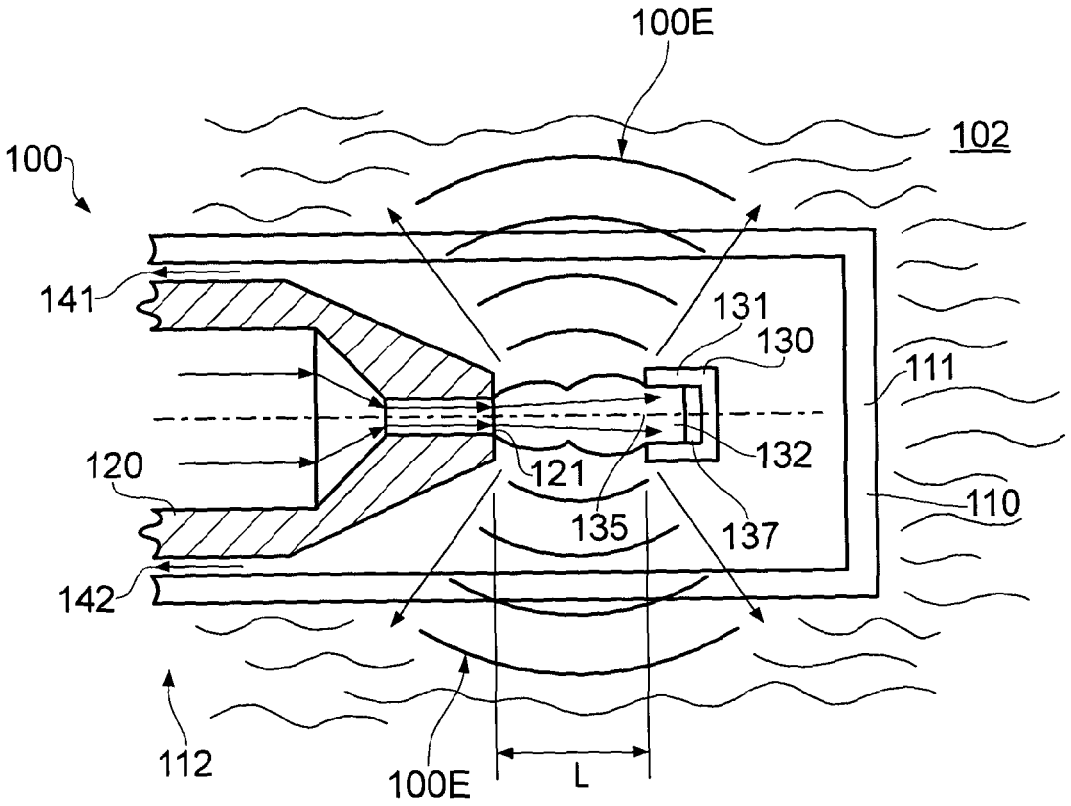
FIG. 1 is a cross-sectional schematic illustration of a fluid delivery device according to an embodiment of the invention.

FIG. 1 shows a fluid delivery device 100 according to an embodiment of the invention. The device 100 has a resonance chamber 110 forming a body portion of the device 100 and a fluid nozzle 120 arranged to supply a flow of gaseous fluid into the resonance chamber 110 through an outlet aperture 121 of the nozzle 120. In some embodiments the device 100 is operated to provide a flow of gas (such as air, nitrogen or other gas such as another inert gas) out from the nozzle 120 at a supersonic velocity of around 300 $ms^{-1}$ or greater. Other velocities are also useful.

In the embodiment shown the nozzle 120 is arranged to provide the flow of gaseous fluid into the resonance chamber 110 in a direction towards a first end 111 of the chamber 110 being a closed end.

At a second end 112 opposite the first end 111 the chamber 110 has openings 141, 142 arranged to allow gaseous fluid to flow out from the chamber 110.

In the embodiment of FIG. 1 a receptor member 130 is provided in the resonance chamber 110. The receptor member 130 is in the form of a cupped member having walls 131 defining an open cavity 137, an opening 135 of the receptor member 130 facing in a direction towards the nozzle 120.

The device 100 is arranged wherein gaseous fluid entering the resonance chamber 110 is directed to flow towards the opening 135 of the receptor member 130.

The flow of gaseous fluid through the nozzle 120 is arranged to occur at a substantially constant rate and pressure. As the gaseous fluid exits the nozzle 120 the fluid expands generating a forward pressure wave travelling in a forward direction towards the receptor member 130.

A portion of the forward pressure wave impinges on the receptor member 130. A pressure of fluid in the receptor member 130 thereby increases and a reverse pressure wave is generated, travelling in a reverse direction to the forward pressure wave. The reverse pressure wave may also be referred to as a 'reflected' pressure wave.

The reverse pressure wave meets the forward pressure wave thus providing a 'feedback' mechanism to the propagation of the forward wave. Interaction of the forward and reverse waves as gaseous fluid exits the receptor member 130 may be arranged to result in the generation of ultrasonic energy.

Gaseous fluid entering the resonance chamber 110 is arranged to exit the resonance chamber 110 through a plurality of outlet conduits 141, 142. In the embodiment of FIG. 1, fluid exiting the resonance chamber 110 flows over an outer surface of the nozzle 120 in a substantially reverse direction to fluid entering the resonance chamber 110.

The device 100 is arranged such that flow of gaseous fluid into the resonance chamber 110 from the nozzle 120 excites resonance of the chamber 110 at a resonant frequency of the device 100 whereby ultrasonic energy may be transmitted into a medium 102 external to the chamber 110. In the embodiment shown the device 100 is arranged to be immersed in a liquid medium thereby to launch the ultrasonic energy into the liquid medium.

It is to be understood that a resonant frequency of the apparatus may depend on a distance between the outlet aperture 121 of the nozzle 120 and the receptor member 130. In the embodiment shown the position of the receptor member 130 is fixed. In some embodiments the distance between the receptor member 130 and the outlet aperture 121 of the nozzle 120 may be changed thereby to change a resonant frequency of the device 100. In some embodiments the position of the receptor member 130 may be changed by means of a screw mechanism thereby to 'tune' the resonant frequency to a desired frequency. Other arrangements are also useful.

It is to be understood that the selection of a resonant frequency of the device 100 may be important in applications where killing of aquatic nuisance species is desirable, such as bacterial species. This is because some bacteria may be more susceptible to death when exposed to ultrasonic waves of a prescribed frequency or range of frequencies than by ultrasonic waves of one or more other frequencies.

Figure 2:
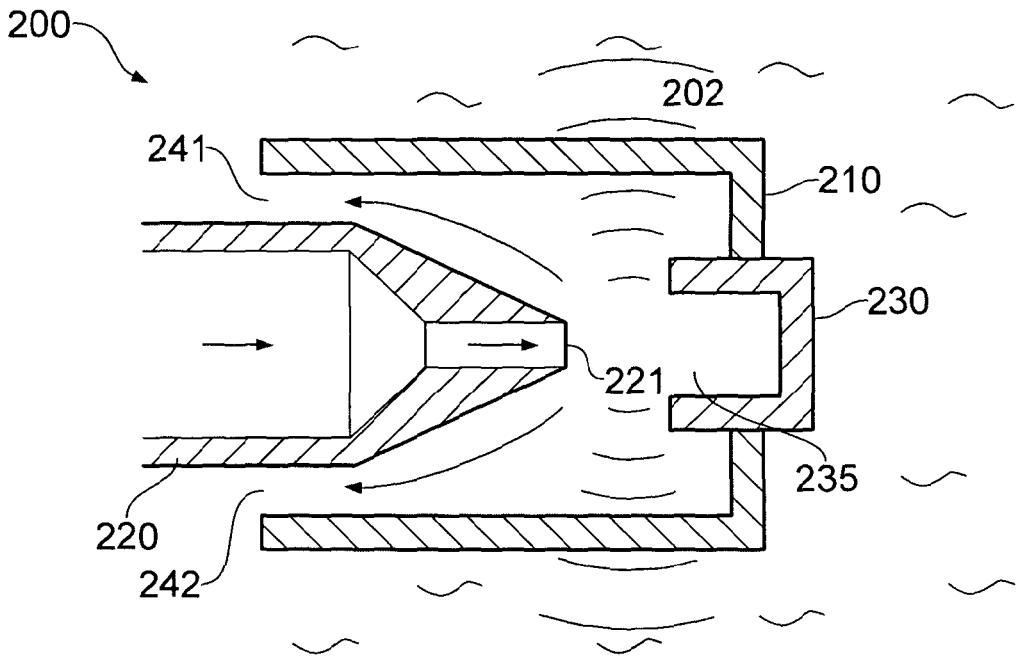
FIG. 2 is a cross-sectional schematic illustration of a fluid delivery device according to a further embodiment of the invention.

FIG. 2 shows a fluid delivery device 200 according to a further embodiment of the invention. Like features of the device 200 of FIG. 2 to those of FIG. 1 are provided with similar reference numerals prefixed with numeral 2 instead of numeral 1.

The device 200 has a resonance chamber 210 into which a nozzle 220 is arranged to provide a flow of gaseous fluid. A receptor member 230 is provided in a wall of the resonance chamber and positioned in a direct line of sight of gaseous fluid entering the resonance chamber 210 through the nozzle 220.

As in the embodiment of FIG. 1 the receptor member 230 is in the form of a cupped member. An external portion of the cupped member is arranged to be in direct thermal communication with an environment external to the device 200.

In use, impingement on the receptor member 230 of gaseous fluid flowing into the resonance chamber 210 causes resonance of the device 200 and the launching of ultrasonic energy into a liquid medium 202 in acoustic communication with the resonance chamber. The device 200 is thereby operable to kill certain ANS such as certain bacterial ANS.

Furthermore, impingement of gaseous fluid on the receptor member 230 is arranged to cause heating of the receptor member 230. Under certain conditions the temperature of the receptor member 230 may rise from ambient temperatures to a temperature in excess of 300° C. or higher due to impingement of the gaseous fluid. It is to be understood that, advantageously, liquid in which the device 200 is immersed may flow in contact with an external surface of the receptor member 230 resulting in heating of the liquid. This may further contribute to death of bacteria or other ANS present in the liquid.

In some applications a fluid delivery device 100, 200 according to an embodiment of the invention is provided in gas lift pump apparatus arranged to cause recirculation of liquid in a ballast tank of a maritime vessel.

Figure 3:
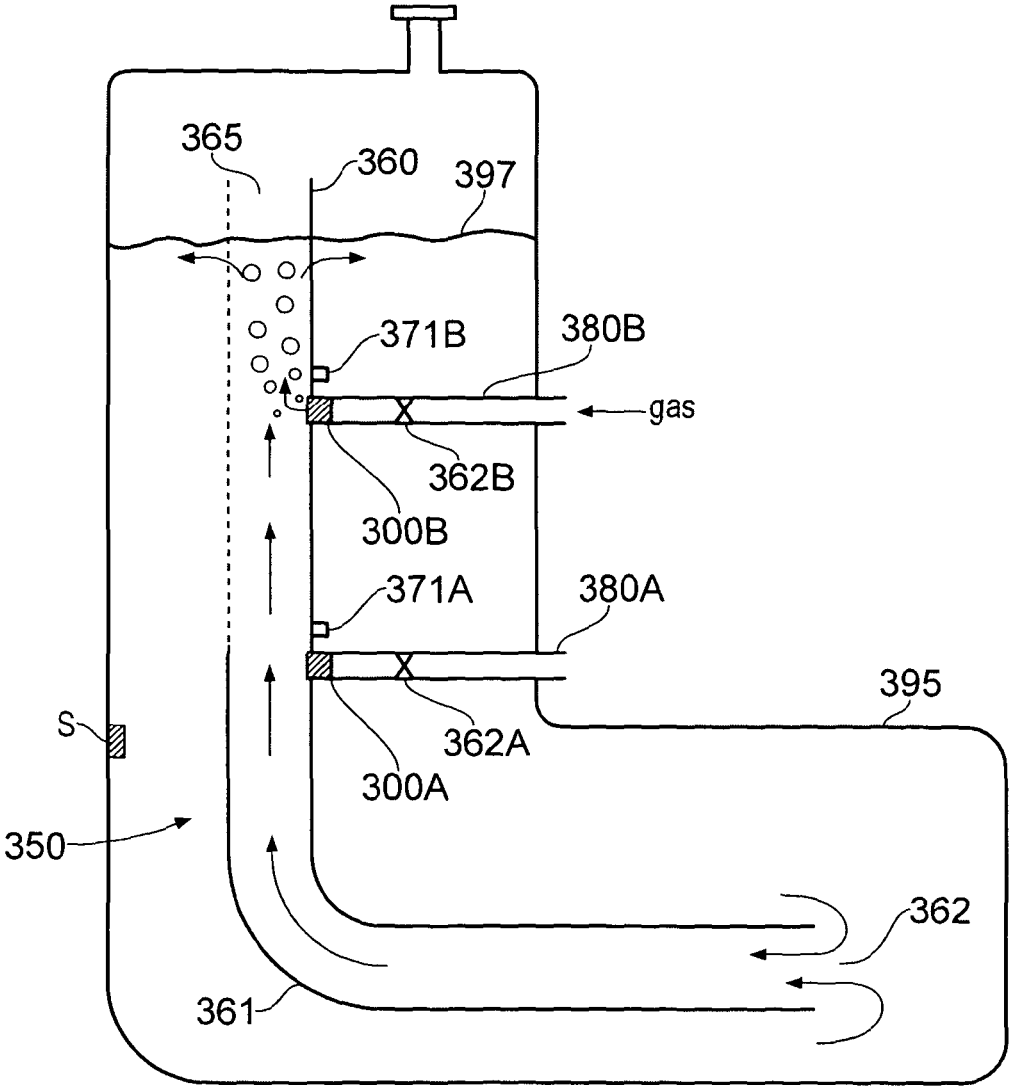
FIG. 3 is a schematic illustration of a gas lift pump apparatus according to an embodiment of the invention installed in a ballast tank of a vessel.

FIG. 3 shows a gas lift pump apparatus 350 installed in a substantially J-shaped ballast tank 395 of a vessel. The pump apparatus 350 may also be described as liquid circulation apparatus.

The apparatus 350 has an immersion member 360 in the form of a substantially hollow tube member 360 provided in a substantially upright orientation within the ballast tank 395.

In the embodiment shown the tube member 360 is substantially 'L'-shaped, having a bend portion 361 arranged to enable a liquid inlet 362 at a lower free end of the tube member 360 to project into a volume of the ballast tank that is displaced in a lateral (i.e. substantially horizontal) direction with respect to a free surface 397 of liquid within the tank 395 when the tank is filled to a level above this volume. The tube member has a liquid outlet 365 at an opposite end of the tube member 360 to the liquid inlet 362.

The tube member 360 has two gas delivery devices 300A, 300B provided at vertically spaced apart locations along a length of the tube member 360. The delivery devices 300A, 300B are supplied with gas through respective fluid supply conduits 380A, 380B.

In the embodiment shown the delivery devices 300A, 300B are each of the type shown in FIG. 1. Other devices 300A, 300B are also useful, such as that shown in FIG. 2 or FIG. 6 (described below).

Valves 362A, 362B are provided in conduits 380A, 380B respectively, upstream of the respective delivery devices 300A, 300B to allow the apparatus to control a flow of gas into the tube member 360.

In the embodiment shown in FIG. 3 a liquid level sensor 371A, 371B is provided above each of the delivery devices 300A, 300B. The purpose of the liquid level sensor 371A, 371B is to provide a signal to a controller of the apparatus 350 indicating that a level of liquid has exceeded the level of the respective delivery device 300A, 300B.

Other locations of liquid level sensor 371A, 371B are also useful. For example, in some embodiments a liquid level sensor may be provided that is arranged to determine a liquid level in the ballast tank 395 by measuring a head of pressure of liquid at a prescribed location, such as a location in a lower region of the tank 395, such as that labelled S in FIG. 3. Other arrangements of one or more liquid level sensors are also useful.

The apparatus is arranged to supply a flow of gas through delivery device 300A if the liquid level sensor 371A associated with device 300A indicates the presence of liquid at the level of sensor 371A unless liquid level sensor 371B indicates the presence of liquid at the level of sensor 371B. In this case, the apparatus is arranged to allow a flow of gas through delivery device 300B and not through delivery device 300A. This allows gas of a lower pressure to be employed to recirculate liquid in the ballast tank 395. This is because a head of pressure in the tank 395 at the level of device 300A is greater than that at the level of device 300B.

It is to be understood that more than two fluid delivery devices 300A, 300B and corresponding liquid level sensors 371A, 371B may be provided. In this case, it follows that the apparatus may be arranged to allow a flow of gas through the highest gas delivery device having a liquid level sensor 371A, 371B associated therewith indicating the presence of liquid at the level of that liquid level sensor 371A, 371B.

Other arrangements are also useful. Thus, the apparatus may be arranged to select a gas delivery device 300A, 300B through which a flow of gas is allowed based on a level of liquid in the fluid tank as determined by a separate fluid level measuring device such as a single fluid level measuring device at location S as discussed above.

The tube member 360 (or 'column') has a plurality of apertures formed through the wall thereof as shown by the dashed outline of the tube member 360 in FIG. 3. The apertures are arranged to allow fluid being pumped by the apparatus 350 to pass therethrough thereby to allow circulation (or 'recirculation') of liquid within the tank 395. Thus liquid may flow out from the tube member 360 through outlet aperture 365 or through the apertures in the sidewall of the tube member 360.

It is to be understood that apertures may be provided in the tube member 360 or like component of each embodiment described herein or any other embodiment to enhance circulation of liquid. This feature has the advantage that liquid flowing through the tube member 360 is not required to flow all the way to a free end of the tube member 360 downstream of the flow of liquid through the tube member 360 in order to be expelled from the tube member 360.

This has the advantage that a flow path of liquid pumped by the apparatus 350 may be optimised for a given tank 395 in which the apparatus 350 is installed. Furthermore, in circumstances in which the tube member 360 is not fully immersed in liquid and the aperture 365 is exposed above a level of liquid in the tank 395 the apparatus 350 is not required to pump liquid above the level of liquid in the tank 395 in order to expel the liquid from the tube member 360.

In some embodiments the apertures are large enough to allow passage of aquatic nuisance species therethrough in order to prevent blockage thereof. In some embodiments the apertures are large enough to allow passage therethrough of any other matter that might be expected to be found in the ballast water in order to prevent blockage of the apertures.

In some arrangements the free end at which the outlet aperture 365 is provided, as shown in FIG. 3, is not required to have an aperture 365. Rather, the free end is a closed end and liquid pumped is required to flow out from the tube member 360 through the apertures in the sidewall of the tube member 360.

Figure 4:
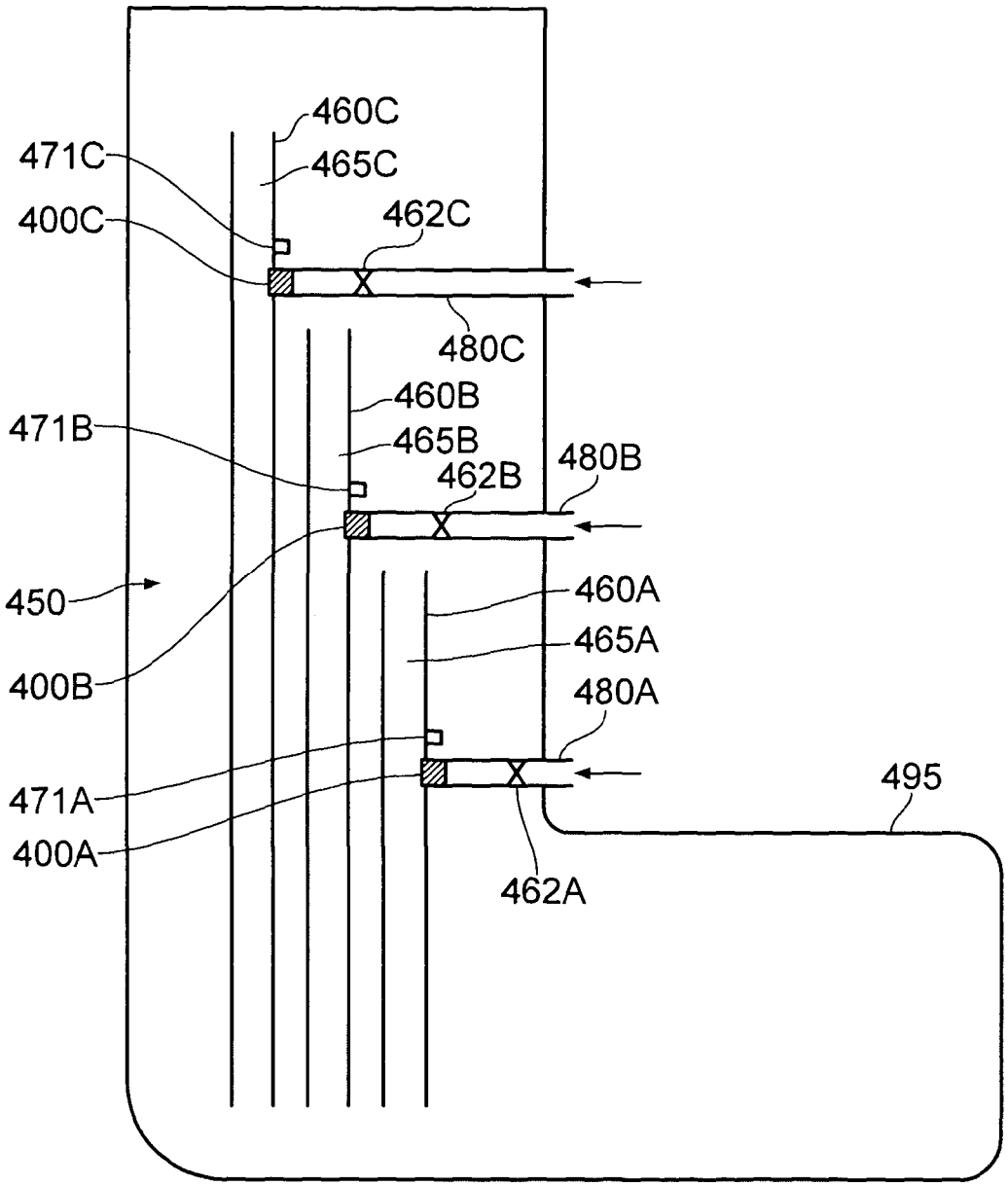
FIG. 4 is a schematic illustration of a gas lift pump apparatus according to a further embodiment of the invention installed in a ballast tank of a vessel.

FIG. 4 shows a further embodiment of the invention in which more than one tube member 460 is provided. In the embodiment of FIG. 4 three tube members 460A, 460B, 460C are provided. It is to be understood that any suitable number of tube members may be provided.

In the embodiment shown each tube member 460A, 460B, 460C has a single gas delivery device 400A, 400B, 400C respectively coupled thereto through which gas may be forced into an inner volume 465A, 465B, 465C of the respective tube member 460A, 460B, 460C. Gas is supplied to each delivery device 400A, 400B, 400C by a respective gas supply conduit 480A, 480B, 480C.

A valve 462A, 462B, 462C such as a check valve is provided in the respective conduit 480A, 480B, 480C upstream of each gas delivery device 400A, 400B, 400C in order to allow a flow of gas through each delivery device 400A, 400B, 400C to be controlled.

Each tube member 460A, 460B, 460C has a liquid level sensor 471A, 471B, 471C respectively provided above the corresponding gas delivery device 400A, 400B, 400C. Once a level of liquid in the ballast tank 495 reaches or exceeds a level of a given liquid level sensor 471A, 471B, 471C, the apparatus is arranged to allow gaseous fluid to pass into the corresponding tube member 460A, 460B, 460C associated with that level sensor 471A, 471B, 471C through the corresponding delivery device 400A, 400B, 400C.

If gaseous fluid is being supplied to any other tube member 460A, 460B, 460C when a further liquid level sensor 471A, 471B, 471C is actuated, supply of gaseous fluid to the other tube member 460A, 460B, 460C may be terminated, in a similar manner to the embodiment of FIG. 3. Other arrangements are also useful.

It is to be understood that the fluid delivery devices of FIG. 1 or FIG. 2 may be used in the apparatus 450 of FIG. 4. Other fluid delivery devices according to embodiments of the invention are also useful such as that of FIG. 6 as described below.

Figure 5:
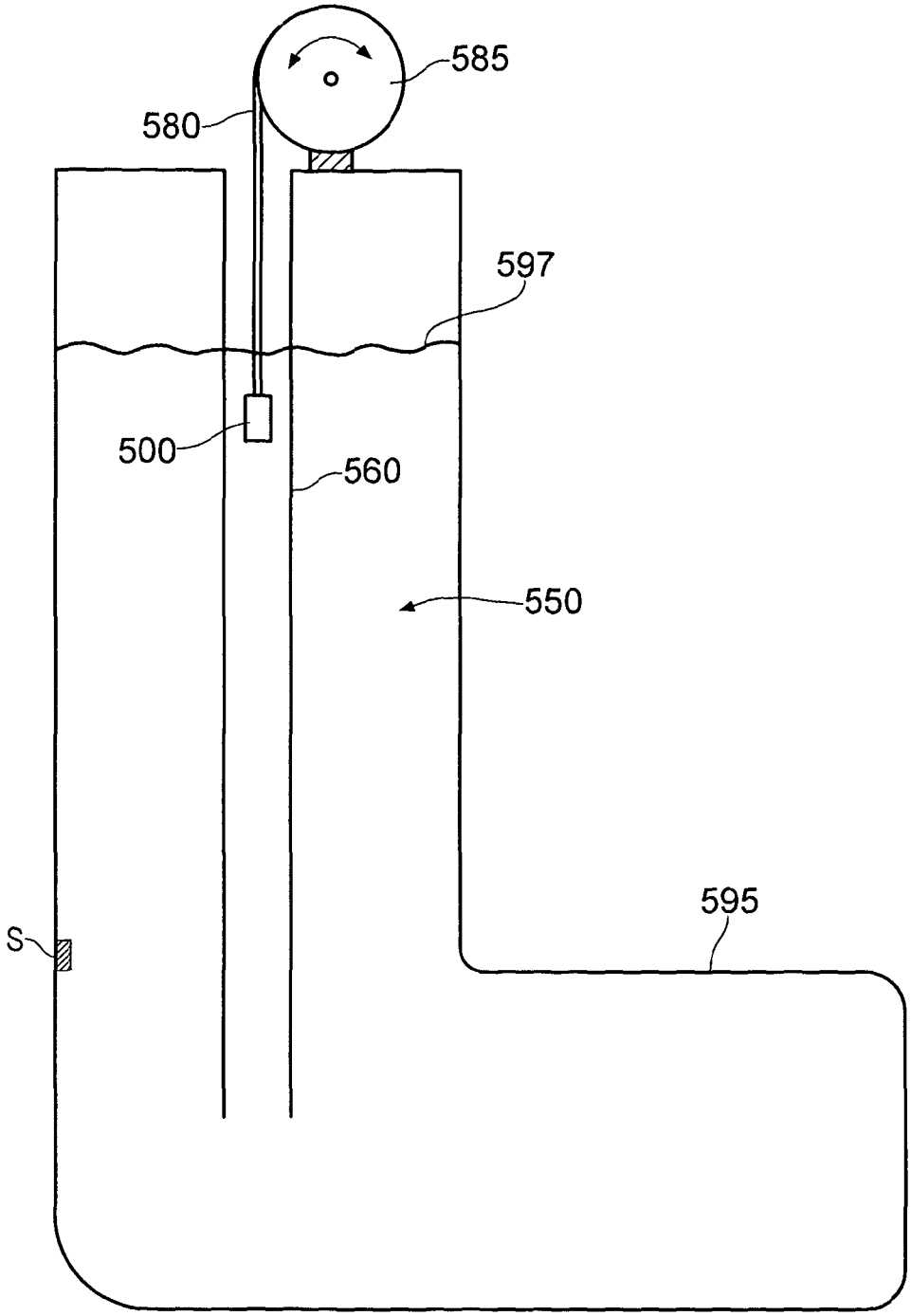
FIG. 5 is a schematic illustration of a gas lift pump apparatus according to a still further embodiment of the invention installed in a ballast tank of a vessel.

FIG. 5 shows apparatus 550 according to an embodiment of the invention in which a tube member 560 is provided having a gas delivery device 500. The delivery device 500 is arranged to be movable in a vertical direction along at least a portion of a length of the tube member 560. In the embodiment shown the delivery device 500 is provided at a free end of a hose 580 arranged to be wound on a drum 585. It is to be understood that the delivery device 500 may be raised or lowered by rotation of the drum 585.

The apparatus 550 is arranged to determine a level 597 of liquid in the fluid tank 595 and to position the gas delivery device 500 a suitable distance below the liquid level 597 to provide effective circulation of liquid in the tank.

In some embodiments a fluid level monitoring device S is provided in a similar manner to that of the embodiment of FIG. 4. The device arranged to determine the level of liquid in the tank 595. The apparatus 550 is arranged to determine a required vertical position of the gas delivery device 500 based on the level of liquid in the tank 595.

Thus, if the level of liquid in the tank 595 rises, the apparatus 550 may be arranged to raise the fluid delivery device 500 thereby to reduce a required pressure of gas flow along the hose 580 in order to force gas through the delivery device. Similarly, if the level of liquid falls, e.g. below a prescribed level, the apparatus 550 may be arranged to lower the device 500 by a prescribed amount or to a prescribed level.

In some embodiments, instead of providing a fluid level monitoring device, the apparatus 550 is arranged to determine a level at which gaseous fluid is to be supplied to the delivery device 500 through the hose 580 by providing a prescribed pressure of gaseous fluid to the fluid delivery device 500 and lowering the device 500 until a flow rate of gaseous fluid through the device 500 falls to or below a prescribed value due to the increasing head of pressure at the device 500 as the device is lowered.

Other arrangements are also useful.

The gas delivery device 500 may be arranged to be self-centering within the tube member 580. In other words, the gas delivery device 500 may be arranged to be positioned substantially coaxially of the tube member when gas is flowing out from the delivery device 500.

In some embodiments the delivery device 500 has gas outlet apertures or outlet nozzles through which gas may flow out from the device 500. The apertures or nozzles may be arranged to cause the gas inlet 332 to be self-centering.

In some embodiments the nozzles may be arranged to direct gas out from the delivery device 500 in a radial direction at circumferentially spaced positions thereby to provide a centering thrust on the device 500.

Figure 6:
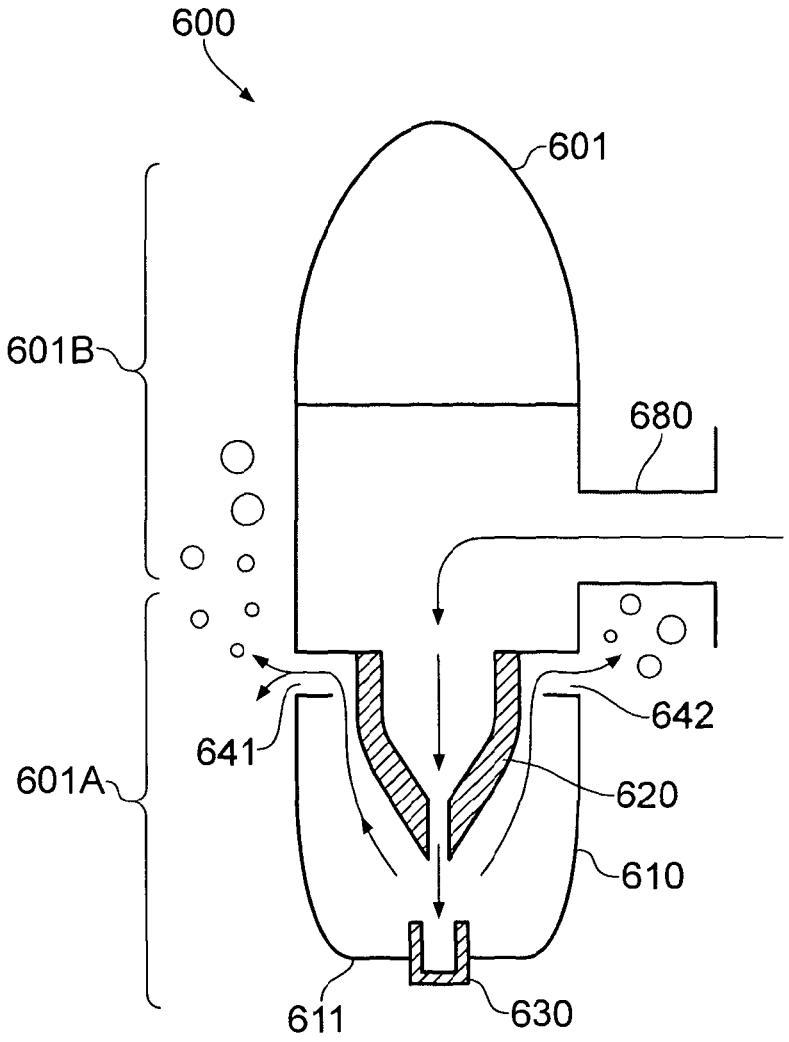
FIG. 6 is a cross-sectional schematic illustration of a fluid delivery device according to a further embodiment of the invention.

FIG. 6 shows a fluid delivery device 600 according to a further embodiment of the invention. The device 600 is provided in a housing 601 arranged to be provided in a flowpath of fluid in a gas lift pump apparatus, i.e. the device is arranged to be mounted in the tube member of the gas lift pump apparatus.

Accordingly the device 600 has an upstream portion 601A and a downstream portion 601B as defined with respect to a direction in which fluid flow through the tube member is expected to occur during a pumping operation (normally an upward direction).

The upstream portion of the device 600 houses a nozzle 620, a resonance chamber 610 and gaseous fluid outlets 641, 642.

The downstream portion 601B of the housing 601 is tapered to reduce an amount of drag on a liquid flowing past the device 600 as it is pumped by the ejection of gas through the outlets 641, 642.

The device 600 has a receptor member 630 coupled to an upstream portion of a wall of the housing 610 and protruding therethrough. In the embodiment of FIG. 6 the receptor member 630 projects to a location upstream of the housing 610. This promotes exposure of liquid flowing past the device 600 to the outer surface of the receptor member 630.

In some embodiments such as that of FIG. 6 the receptor member 630 is arranged to be heated by the flow of gaseous fluid through the device 600 whereby certain ANS may be killed.

Figure 7:
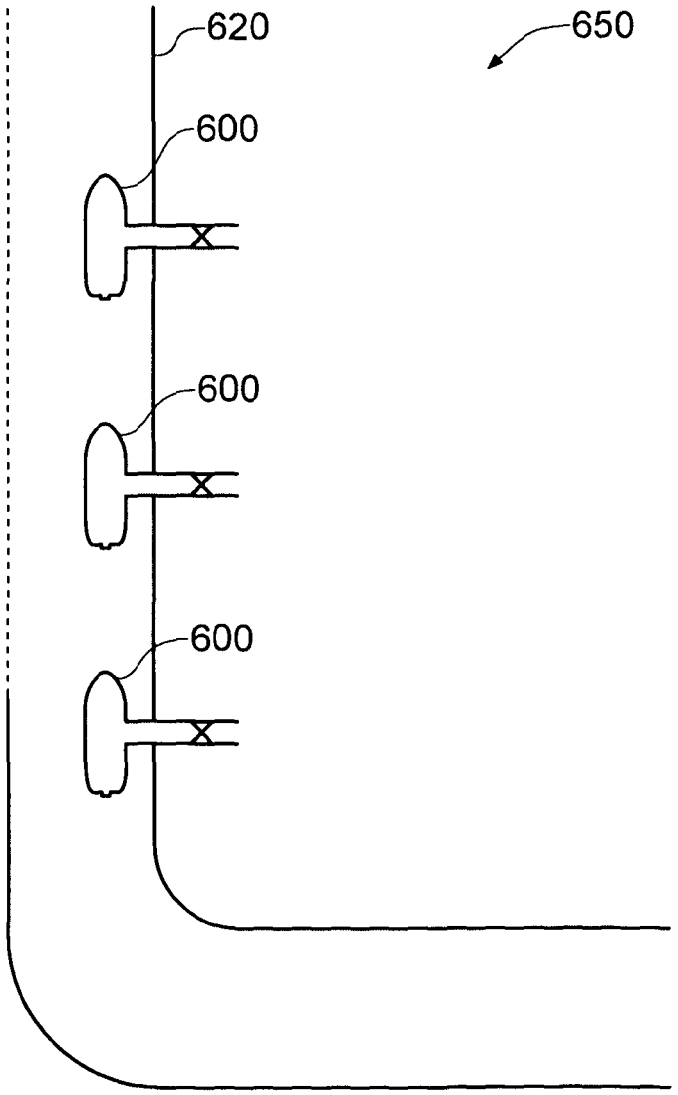
FIG. 7 is a schematic illustration of a gas lift pump apparatus according to an embodiment of the invention provided with a fluid delivery device according to the embodiment of FIG. 6.

FIG. 7 shows gas lift pump apparatus 650 according to an embodiment of the invention having a tube member 620 provided with three fluid delivery devices 600. The devices are provided at vertically spaced locations along the tube member 620. Furthermore the devices 600 are provided at locations spaced apart from an inner wall of the tube member 620 away from a boundary layer of liquid flowing through the tube member 620. This increases an efficiency of the pump apparatus 650.

It is to be understood that embodiments of the invention have the advantage that ANS present in a liquid storage tank may be killed by passage of gaseous fluid through a fluid delivery device according to an embodiment of the present invention. This is at least in part because the delivery device is arranged to launch ultrasonic energy into the liquid in the storage tank. As noted above, heating of bacteria or other ANS through contact with a receptor member at an elevated temperature may also contribute to death of ANS.

In embodiments of the invention in which a fluid delivery device is installed in a gas lift pump apparatus, the circulation of liquid through the pump apparatus enables the volume of liquid in the tank that may be exposed to the ultrasonic energy to be increased. In other words, the volume of liquid that may be treated by exposure to the ultrasonic energy may be increased.

Figure 8:
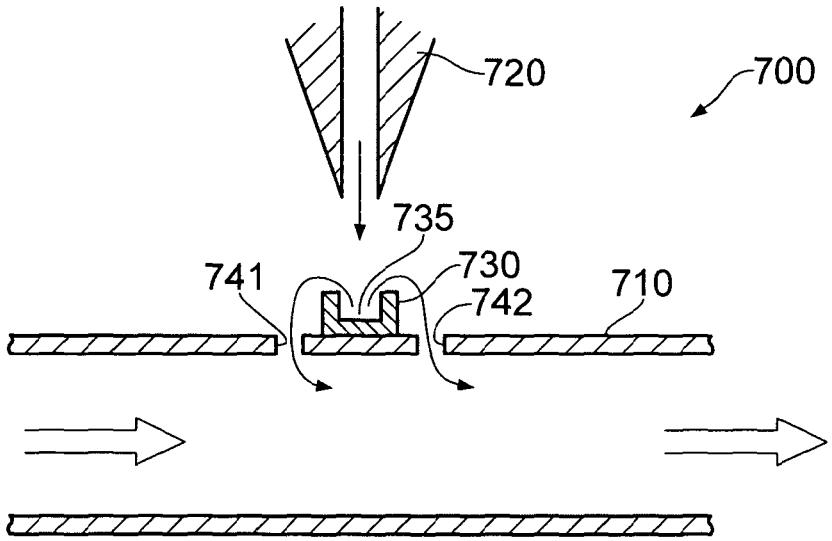
FIG. 8 is a schematic illustration of a fluid delivery device according to an embodiment of the invention.

FIG. 8 shows a fluid delivery device 700 according to a further embodiment of the invention. The device 700 has a fluid nozzle 720 and a receptor member 730. The receptor member 730 has a cupped shape as in the case of the embodiments described above and defines a cavity 735. The nozzle member 720 is arranged to direct a flow of gaseous fluid into the cavity 735.

The receptor member 730 is coupled to a fluid conduit or pipe 710 through which liquid may be arranged to flow. In use, gaseous fluid is forced through the nozzle 720 and towards the cavity 735 of the receptor member 730. Ultrasonic energy is generated when the rate of flow of gaseous fluid through the nozzle 720 is sufficiently high. The device 700 is arranged such that the pipe 710 serves as a resonance chamber whereby ultrasonic energy is launched into the liquid flowing through the pipe 710. In the embodiment shown the pipe 710 provides the column of a gas lift pump apparatus.

The flow of gaseous fluid through the device 700 is further arranged such that gaseous fluid emanating from the nozzle ultimately flows into the pipe 710 thereby causing pumping of fluid in the pipe 710 by gas lift. To this end, apertures 741, 742 are provided in a wall of the pipe 710 to allow gaseous fluid into the pipe 710.

In some embodiments the apertures 741, 742 are themselves arranged to generate ultrasonic energy as gaseous fluid passes through them in addition to that generated by the flow of fluid from the nozzle 720 into the receptor member 730. Thus, the apertures 741, 742 may themselves act as 'whistles' to generate ultrasonic energy.

It is to be understood that, alternatively or in addition, gaseous fluid may be introduced into the pipe 710 by alternative means, such as a conventional gaseous fluid injector not being arranged to generate ultrasonic energy.

It is to be understood that a position of the receptor member 730 and nozzle 720 with respect to a length of the pipe 710 may be important in some embodiments in order to enable or enhance the launching of the ultrasonic energy into the pipe 710.

In some embodiments the receptor member 730 and nozzle 720 are located a distance of around $\lambda/2$ from one end of the pipe, where $\lambda$ is the wavelength of the ultrasonic energy, and a distance of around $3\lambda$ from an opposite end of the pipe. Other arrangements are also useful.

It is to be understood that the length and diameter of the pipe 710, the dimensions of the nozzle and receptor member configuration and the flow rate of fluid through the nozzle may be arranged to generate a desired frequency of ultrasonic energy to optimise killing of ANS.

Furthermore, in some embodiments of the invention the gaseous fluid delivered by the fluid delivery device is arranged to kill ANS by increasing a concentration of the gaseous fluid in the liquid. It is to be understood that increasing the concentration of the gaseous fluid in the liquid may in turn result in a decrease in a concentration of one or more other gases in the liquid. For example, increasing the concentration of carbon dioxide in seawater is known to result in a decrease in the concentration of oxygen. This may alone or in addition contribute to death of one or more types of ANS.

Figure 9:
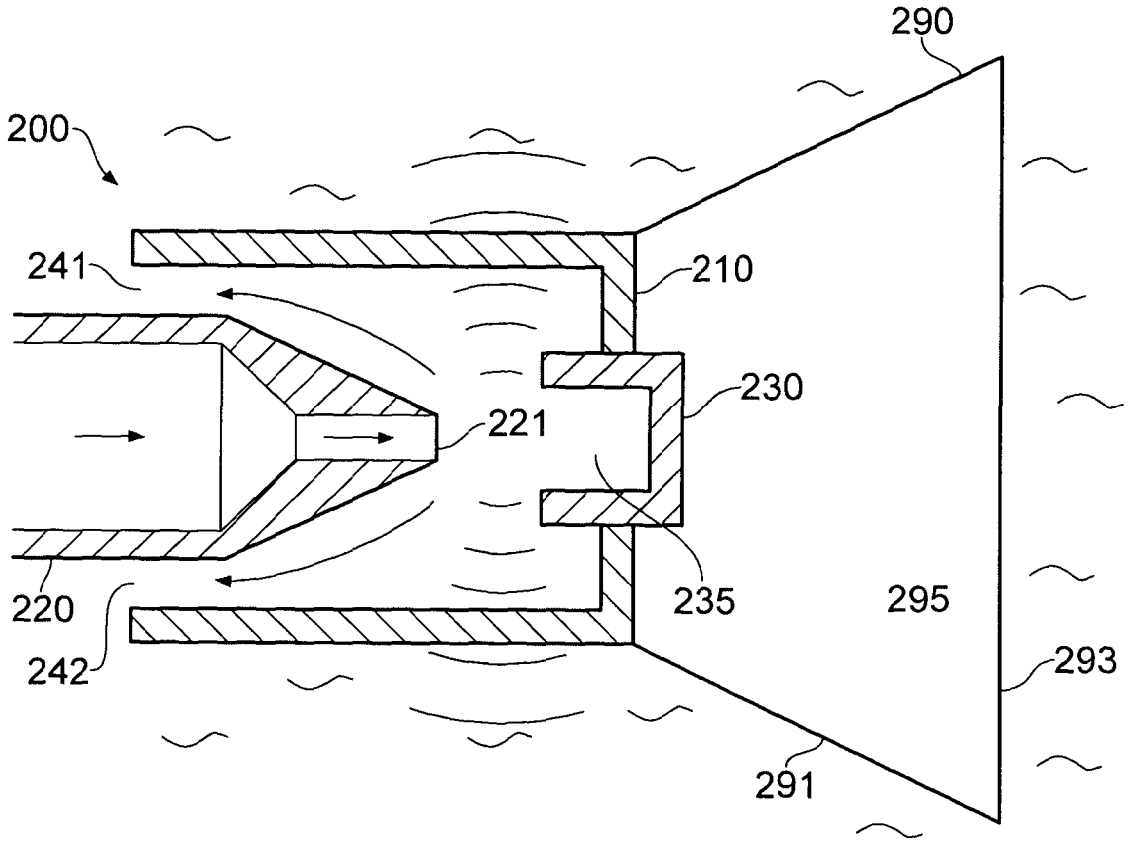
FIG. 9 is a cross-sectional schematic illustration of a fluid delivery device according to a further embodiment of the invention.

FIG. 9 is a schematic cross-sectional illustration of the fluid delivery device of FIG. 2 fitted with an amplification chamber 290. The chamber 290 has a substantially frusto-conical body portion 291 having a membrane 293 arranged to define a wall of the amplification chamber 290 at a basal (wider) end of the body portion 291.

At an opposite end of the amplification chamber 290 the chamber 290 is coupled to the device 200 such that an external surface of the receptor member 230 forms an apical wall of the chamber 290. Thus, the device 200 is arranged to direct ultrasonic energy directly into the amplification chamber 290.

The amplification chamber 290 is filled with gas and the device 200 is arranged such that in use the chamber 290 enables an increase in the amplitude of ultrasonic energy launched into liquid 202 in which the device and chamber 290 are immersed. In some embodiments this is at least in part because the amplification chamber 290 is arranged to reduce a mismatch in impedance between the device 200 and the liquid 202 thereby more efficiently to communicate energy from the device 200 to the liquid 209.

The amplification chamber 290 of the embodiment shown is formed from a metallic material. It is to be understood that other materials are also useful including plastics materials.

Figure 10:
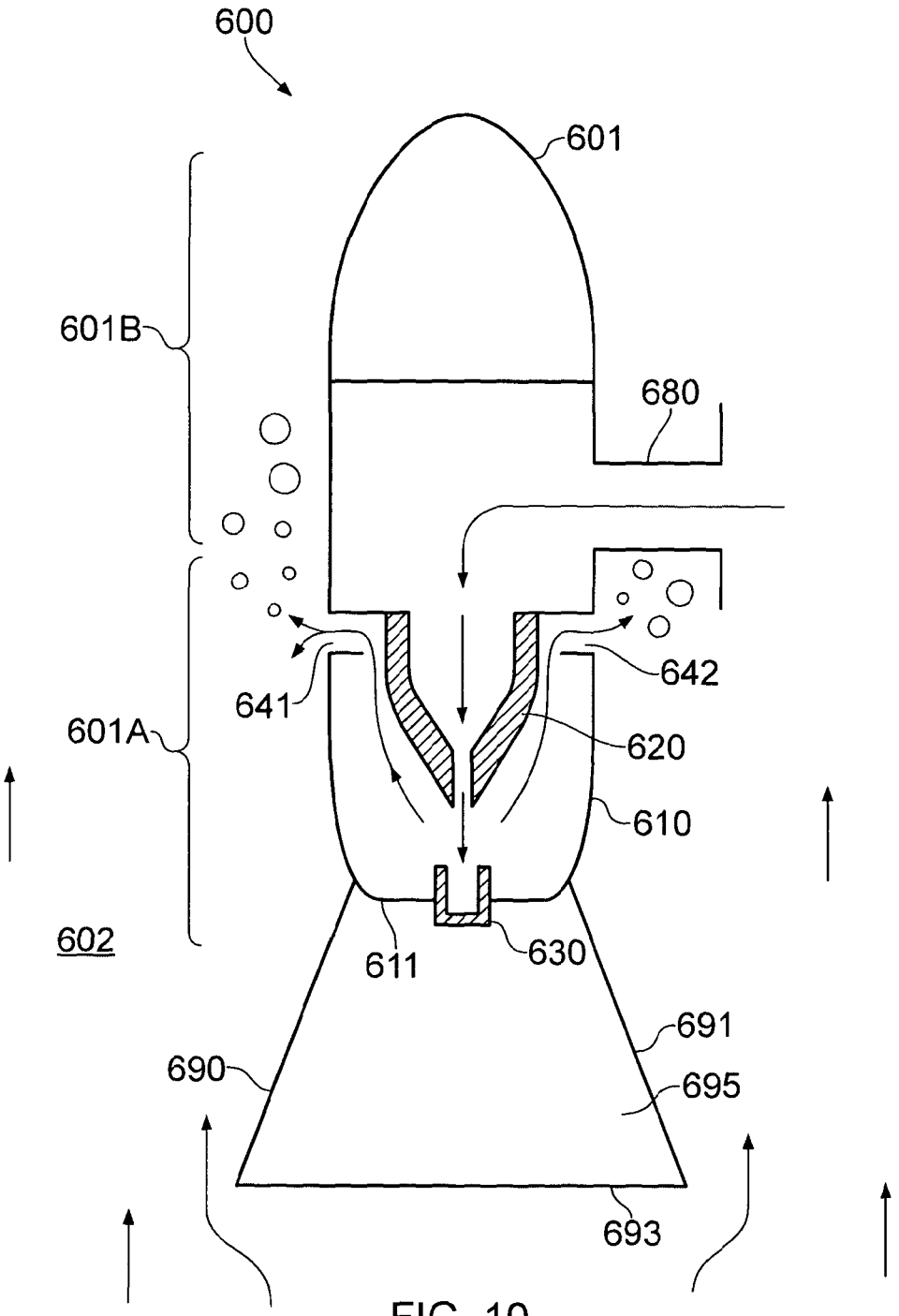
FIG. 10 is a cross-sectional schematic illustration of a fluid delivery device according to a still further embodiment of the invention.

FIG. 10 is a schematic illustration of a fluid delivery device 600 according to the embodiment of FIG. 6 fitted with an amplification chamber 690 similar to that of the embodiment of FIG. 9.

The chamber 690 is fitted to the device 600 so as to enclose the receptor member 630 such that the receptor member 630 provides a portion of a wall of the chamber 690. Thus the device 600 is arranged to direct ultrasonic energy directly into the chamber 690 which in turn directs the ultrasonic energy into the surrounding liquid medium 602.

It can be seen from FIG. 10 that the amplification chamber 690 is oriented so as to face upstream of the flow of liquid pumped. Other arrangements are also useful. For example in some embodiments the amplification chamber 690 may be arranged to face downstream of the flow of liquid pumped. In some alternative embodiments the chamber 690 may be provided normal to a flow direction of liquid pumped.

Figure 11:
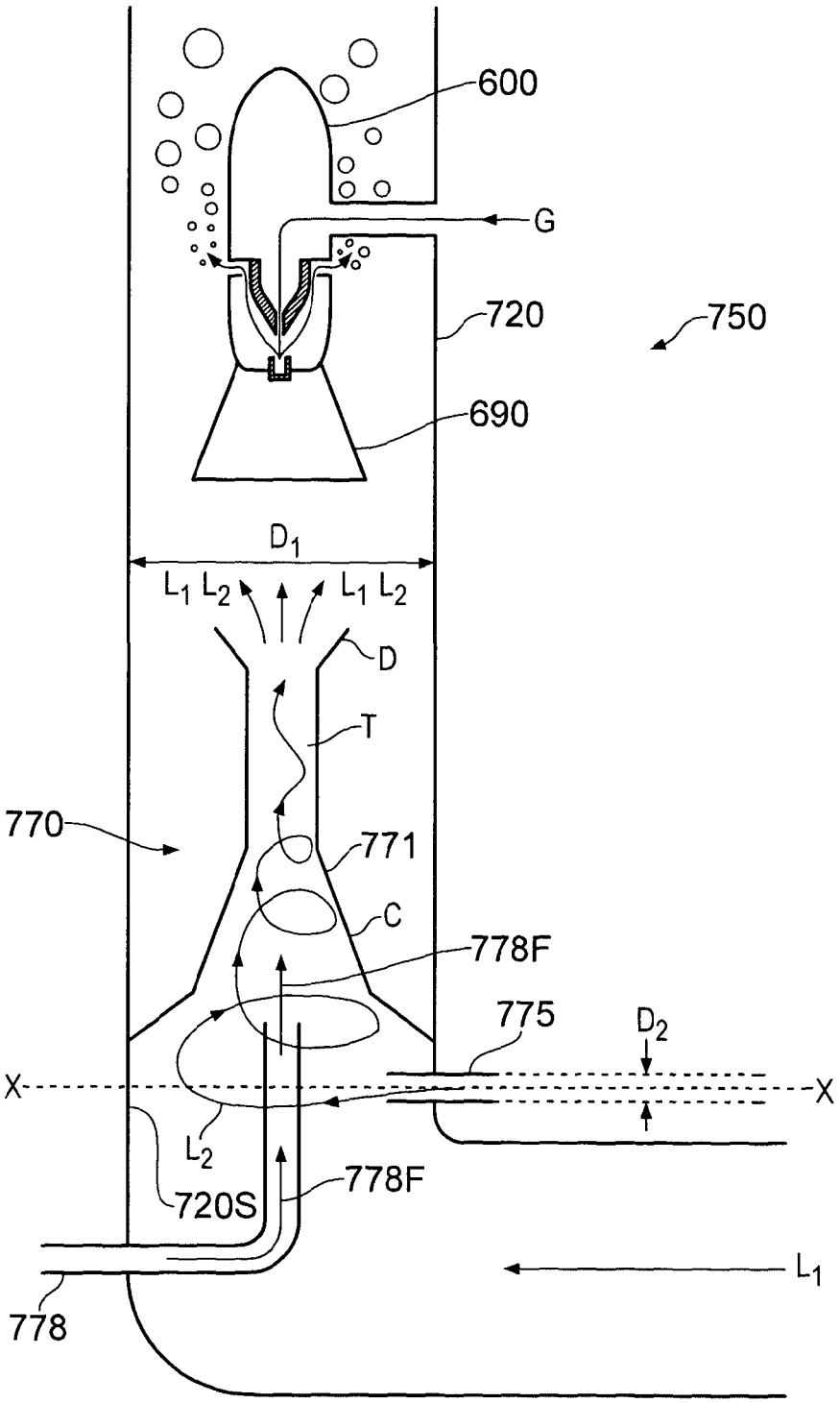
FIG. 11 is a cross-sectional schematic illustration of a gas lift pump apparatus according to an embodiment of the invention provided with a fluid delivery device according to the embodiment of FIG. 10.

FIG. 11 is a schematic illustration of gas lift pump apparatus 750 according to an embodiment of the invention. The apparatus 750 has a substantially J-shaped liquid column 720 similar to that of the apparatus 650 of FIG. 7. A fluid delivery device 600 similar to that shown in FIG. 10 is provided in the column 720 and oriented as shown.

Thus, the amplification chamber 690 of the device 600 faces against a direction of flow of liquid $L_1$ pumped by the apparatus through the column 720. In the arrangement shown the amplification chamber 690 faces substantially vertically downwards.

The apparatus 750 has a microbubble generator 770 upstream of the fluid delivery device 600. In the embodiment of FIG. 11 the microbubble generator 770 is positioned below the fluid delivery device 600.

The generator 770 has a venturi portion 771 having the shape of a conventional venturi device. In the embodiment of FIG. 11 the venturi portion 771 is arranged such that liquid flowing through the column 720 is forced to flow through the venturi portion 771. The venturi has a converging portion C arranged to direct the liquid through a throat portion T and subsequently through a diverging portion D in the conventional manner.

Figure 12:
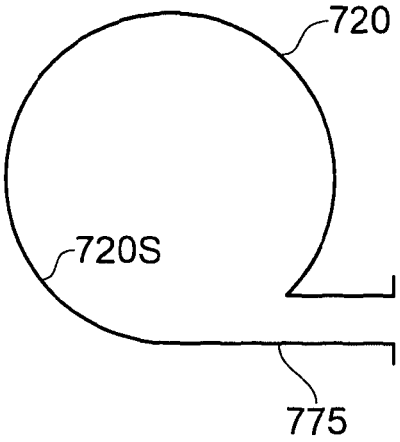
FIG. 12 is a cross-sectional view of a column of the gas lift apparatus of FIG. 11 showing the orientation of a tangential fluid injection port.

A liquid injector 775 is arranged to inject a flow of liquid $L_2$ into the column 720 upstream of the venturi portion 771. A cross-sectional view of the column 720 at position X-X is shown in FIG. 12.

It can be seen that the liquid injector 775 is configured to inject liquid $L_2$ into the column 720 in a direction substantially tangential to an inner surface 720S of the column 720 such that the liquid L2 has a component of velocity in a single angular direction within the column 720, i.e. the fluid swirls in substantially one direction. It is to be understood that the fluid will also have a component of velocity in an axial direction along the column 720 as it moves through the column 720. Thus, the injector 775 is arranged to promote the establishment of a flow vortex within the column 720.

A gas injector 778 is arranged to inject a flow of gas 778F into the column 720 upstream of the venturi portion 771. In the embodiment shown the gas injector 778 is arranged to inject the gas at a position downstream of the liquid injector 775.

The apparatus 750 is arranged such that as liquid from the liquid injector 775 and gas from the gas injector 778 enter the venturi portion 771 microbubbles are generated. The microbubbles act as sites to which bacterial ANS within the liquid may become attached.

A probability of death of bacterial ANS by ultrasonic energy produced by the fluid delivery device 600 is increased by the formation of the microbubbles. This is at least in part because the ultrasonic energy can cause violent rupture of the microbubbles thereby causing damage and death to bacterial ANS trapped by a microbubble.

In some embodiments the column 720 has a diameter of around 8 inches (around 20 cm) and the liquid injector 775 has a diameter of around 2 inches (around 5 cm). In the embodiment shown having these dimensions the injector 775 may be arranged to provide a liquid flow rate into the column 720 of around 200 $m^3/h$.

The fluid delivery device 600 may be supplied with a gas flow rate of around 50 normal $m^3/h$ at a pressure of around 3.5-4.0 bar gauge (350-400 kPa).

Other values of one or more dimensions and/or one or more operating parameters are also useful in some embodiments.

It is to be understood that some embodiments of the invention employing a microbubble generator 770 are operable more efficiently to destroy bacterial ANS. Furthermore, embodiments of the invention employing an amplification chamber 690 are also operable more efficiently to destroy bacterial ANS.

Figure 13:
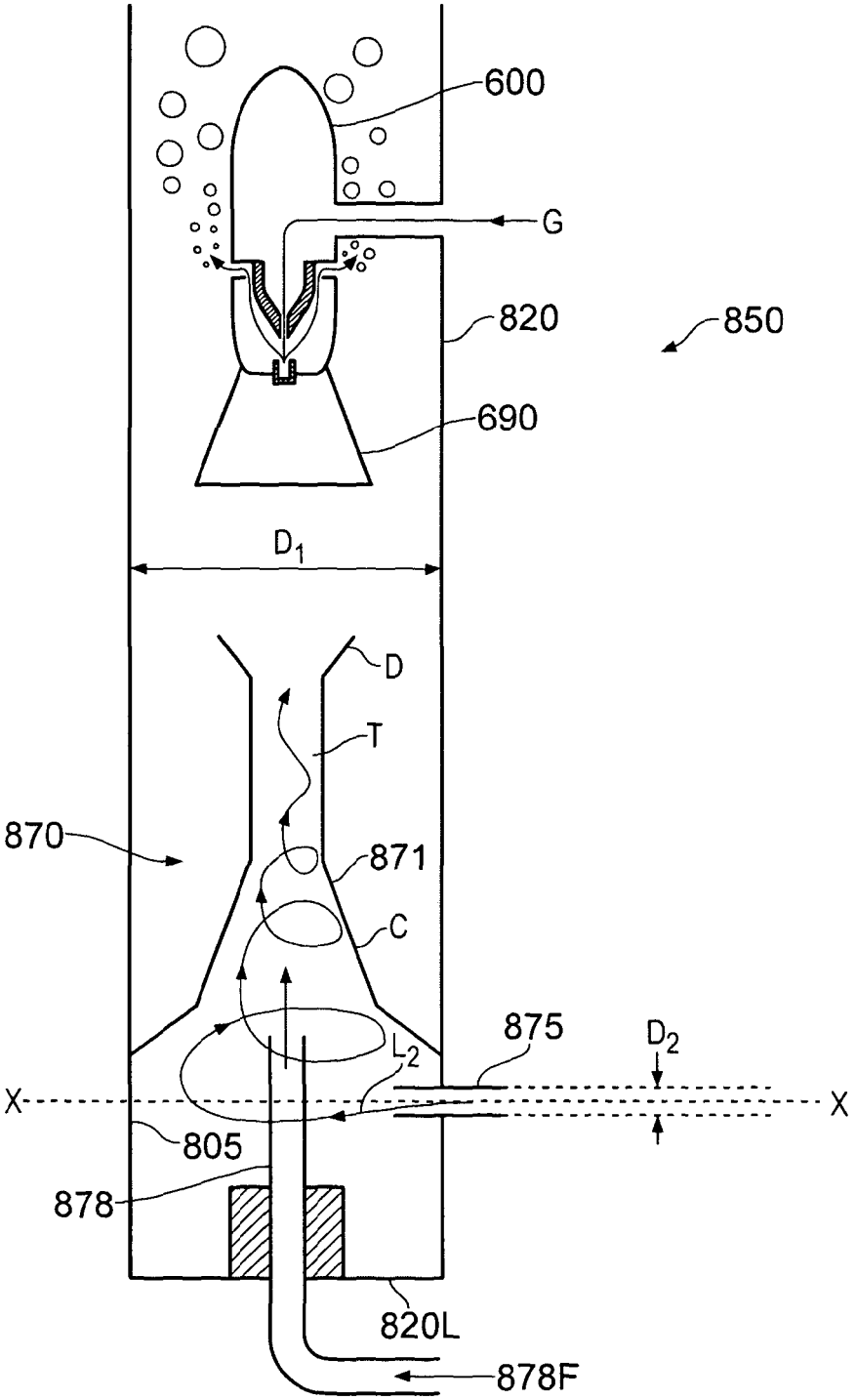
FIG. 13 is a cross-sectional schematic illustration of a gas lift pump apparatus according to a further embodiment of the invention provided with a fluid delivery device according to the embodiment of FIG. 10.

FIG. 13 is a schematic illustration of gas lift pump apparatus 850 according to a further embodiment of the invention. Like features of the apparatus of FIG. 13 to those of the apparatus of FIG. 11 are labelled with identical reference signs or like reference signs prefixed numeral 8 instead of numeral 7.

The apparatus 850 is similar to that of FIG. 11 except that the column 820 is closed at a lower end 820L such that the only liquid entering the column 820 at the lower end 820L is that from liquid injector 875.

A gas injector 878 is arranged to deliver a flow of gas 878F into the column 820 immediately downstream of the liquid injector 875 and upstream of the venturi portion 871.

It is to understood that in the embodiment of FIG. 13 the pumping rate of the apparatus 850 may be limited at least in part by the rate at which liquid L2 is injected into the column 820.

In contrast, in the embodiment of FIG. 11 the pumping rate may be limited by the rate at which liquid L2 and liquid L1 are able to pass through the column 720. It is to be understood that this rate may be controlled at least in part by the rate at which liquid L2 is forced into the column 720 and a rate at which gas is injected into the column 720 via gas injector 778 and fluid delivery device 600.

In the embodiments of FIG. 11 and FIG. 13 all liquid flowing up the column from below the venturi portions 771, 871 flows through the venturi portions 771, 871. In some embodiments some liquid is able to bypass the venturi portion (see the embodiment of FIG. 15 described below).

Figure 14:
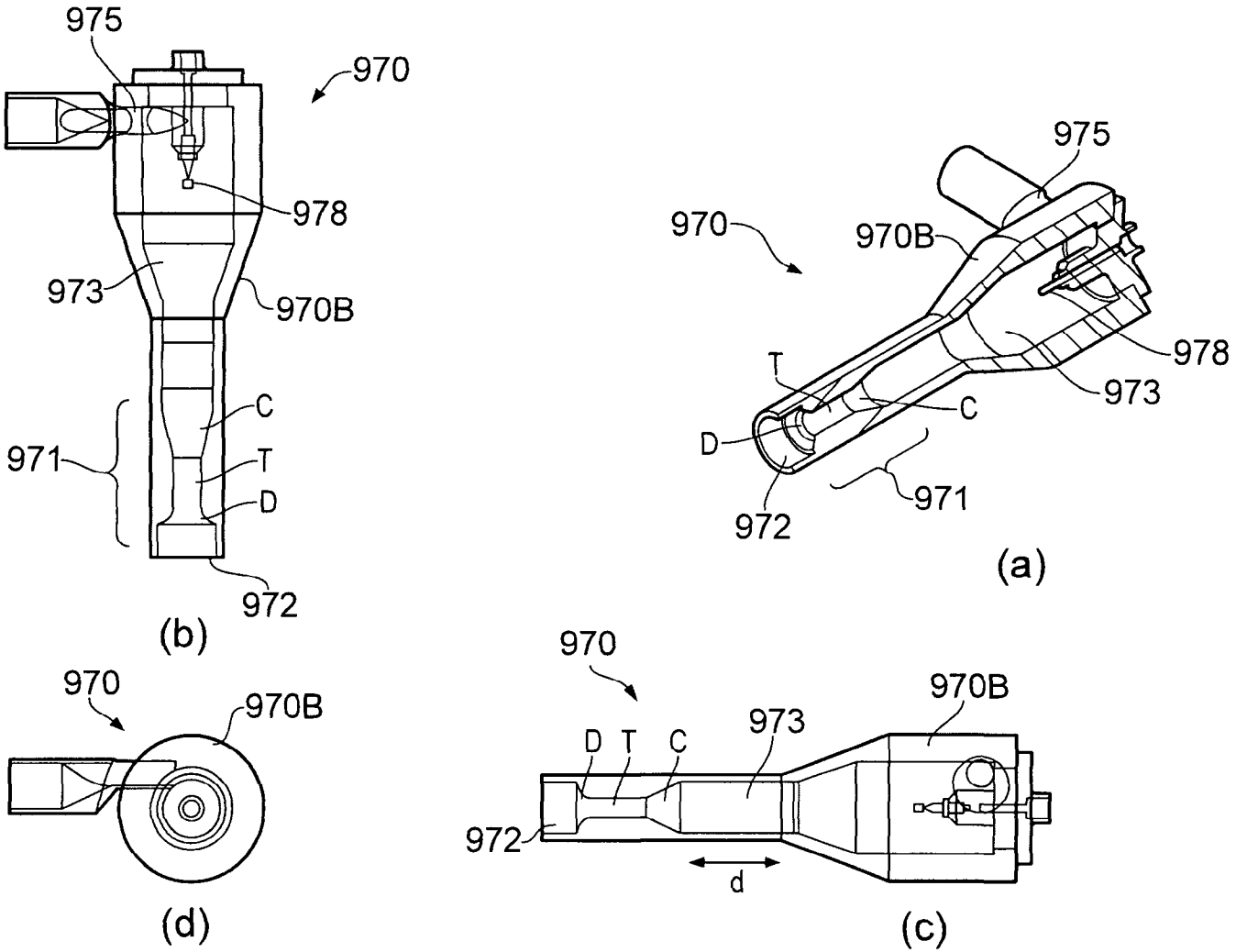
FIG. 14 shows a microbubble generator suitable for use in some embodiments of the invention in (a) perspective view, (b) side view, (c) front view and (d) top view.

FIG. 14(*a*) is a perspective view of a microbubble generator 970 suitable for use with embodiments of the present invention.

The generator 970 has a body portion 970B having a liquid injector 975 and a gas injector 978 at one end arranged to inject liquid and gas, respectively, into an internal fluid conduit 973 of the generator 970. The conduit 973 is substantially circular in cross-section, the liquid injector 975 being arranged to inject liquid into the conduit 973 along a direction substantially tangential to the conduit 973 as viewed along a longitudinal axis of the conduit 973 similar to the arrangement of FIG. 12. This is so as to promote establishment of a liquid flow vortex as the liquid passes along the conduit 973 towards a venturi portion 971. Establishment of the flow vortex promotes mixing of the gas and liquid.

The generator 970 is operable to generate microbubbles in the liquid as the liquid and gas pass through the venturi portion 971. Thus a flow of liquid having microbubbles entrained therein may be provided from a fluid outlet 972 of the generator 970.

It is to be understood that the generator 970 and a fluid delivery device according to an embodiment of the invention (see FIGS. 1 to 6) may be employed either in gas lift pump apparatus or separately in a ballast tank, a fluid conduit or any other suitable location.

Figure 15:
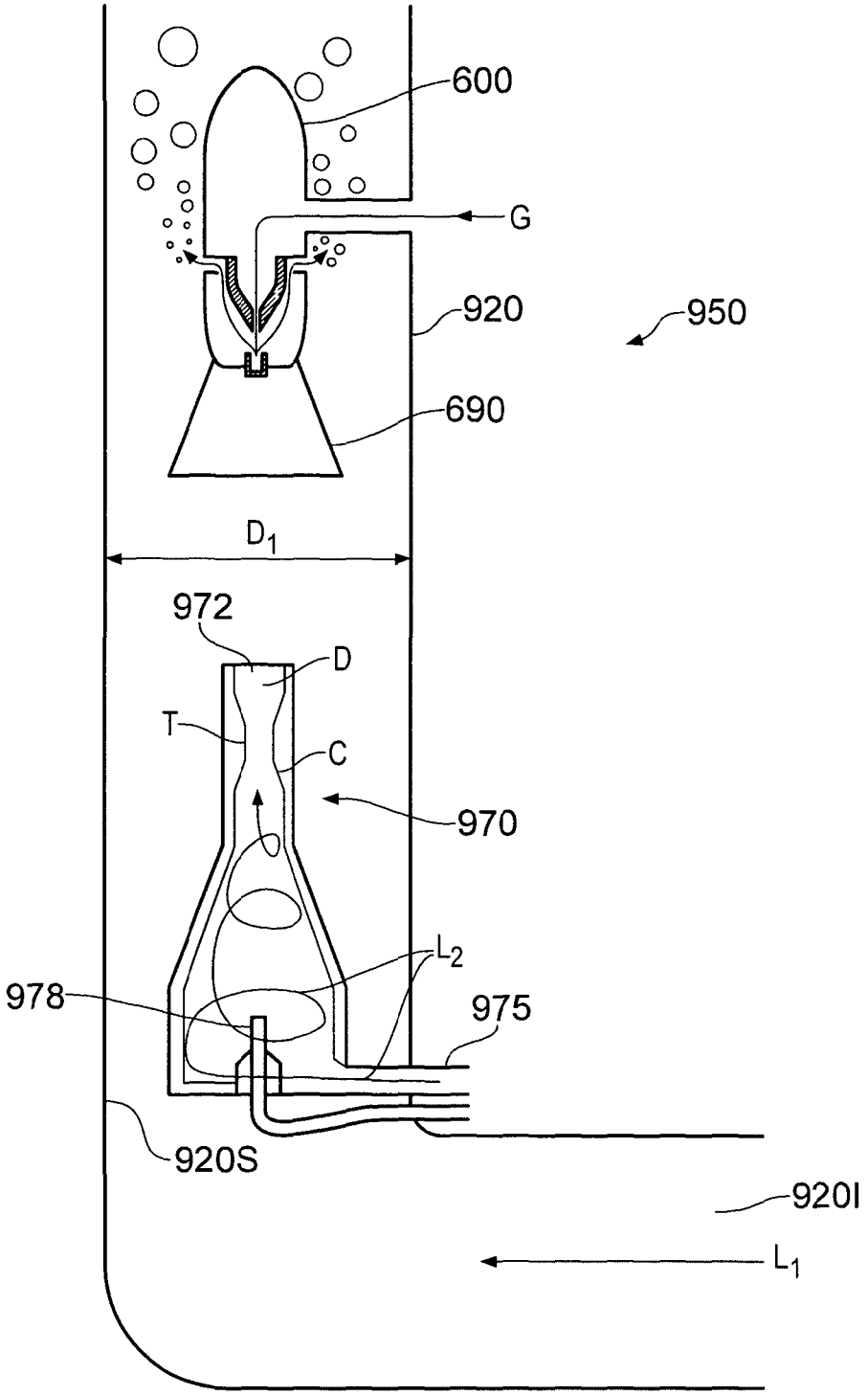
FIG. 15 shows gas lift pump apparatus according to an embodiment of the invention having the generator of FIG. 14 and a fluid delivery device according to the embodiment of FIG. 10.

FIG. 15 shows an embodiment of the invention in which a fluid delivery device 600 is provided in a column 920 of a gas lift pump apparatus 950. Like features of the apparatus of FIG. 15 to those of the apparatus of FIG. 11 are labelled with identical reference signs or like reference signs prefixed numeral 9 instead of numeral 7.

A microbubble generator 970 substantially as described above and illustrated in FIG. 14 is mounted in the column 920 of the apparatus 950.

The generator 970 is operable to inject a flow of liquid $L_2$ in which microbubbles are entrained into the column 920 via outlet 972 and towards the fluid delivery device 600. It is to be understood that the apparatus 950 is also operable to pump liquid $L_1$ through the column from an inlet 920I of the column 920 by gas lift, by means of gas injected into the column via the fluid delivery device 600, as well as by a pressure of liquid injected into the column 920 via liquid injector 975 of the generator 970.

It is to be understood that injection of gas into the column 920 in the form of microbubbles by means of gas injector 975 may also assist in pumping liquid $L_1$ through the column 920 by gas lift.

It is to be understood that other arrangements are also useful in which a microbubble generator 970 provides a flow of entrained microbubbles to a fluid delivery device according to an embodiment of the invention. Embodiments of the invention are operable to kill bacterial ANS as well as non-bacterial ANS.

In the embodiment of FIG. 15 the generator 970 is shown positioned in the flowstream of liquid L1. The generator 970 may alternatively be provided at a base of a column having a closed lower end, such as the end 820L of the column 820 of the embodiment of FIG. 13.

Figure 16:
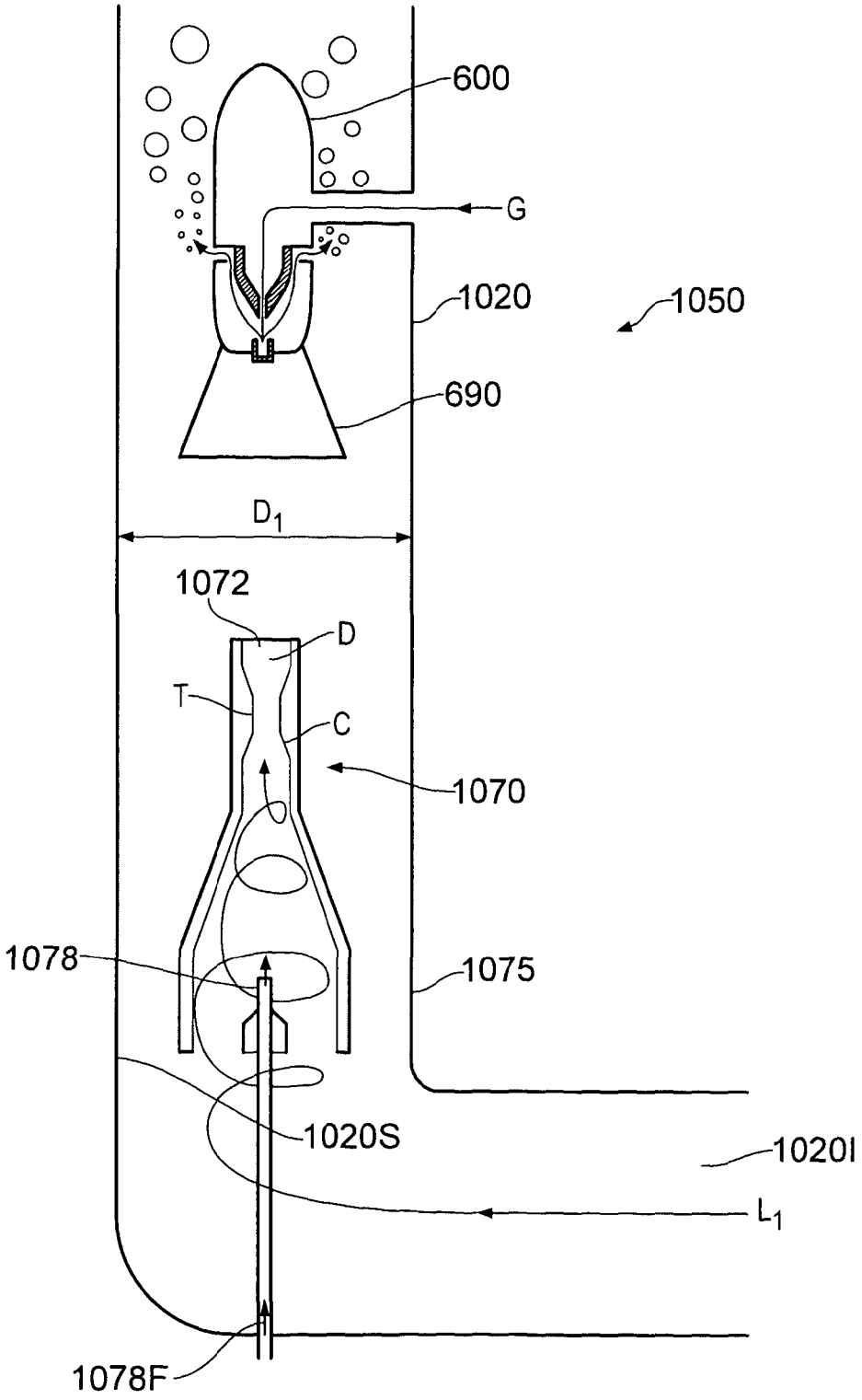
FIG. 16 shows gas lift pump apparatus according to a further embodiment of the invention having the fluid delivery device of the embodiment of FIGS. 10.

FIG. 16 is a schematic illustration of gas lift pump apparatus 1050 according to a further embodiment of the invention. Like features of the apparatus of FIG. 16 to those of the apparatus of FIG. 15 are labelled with like reference signs prefixed '10' instead of numeral 9.

The apparatus 1050 of FIG. 16 is similar to that of FIG. 15 in that it has a substantially J-shaped gas lift column 1020 having a fluid delivery device 600 provided therein. It is to be understood that apparatus according to embodiments of the invention may have any number of fluid delivery devices 600 provided therein.

The apparatus 1050 has a microbubble generator 1070 provided upstream of the fluid delivery device 600. The generator 1070 is similar to that of the embodiment of FIG. 15 except that the generator 1070 does not have a liquid injector 975. Instead, an upstream end of the generator 1070 is arranged to receive a flow of liquid L1 entering the column 1020 through an inlet 1020I at the upstream end of the column 1020. (In the embodiment shown the upstream end is also the lowermost end). It can be seen that a portion of the liquid $L_1$ entering the column 1020 through the inlet 1020I flows around an outside of the generator 1070. However a portion of the liquid flows through the generator 1070.

A flow of gas 1078F is provided through the generator 1070 by means of a gas injector 1078. The injector 1078 is arranged such that as liquid $L_1$ flows therethrough microbubbles are formed in the liquid $L_1$.

In the embodiment shown the column is 1020 is arranged to introduce swirl into the liquid L1 once it has entered the column 1020 through the inlet 1020I. Swirl is useful in encouraging the formation of microbubbles in the flow of liquid $L_1$ through the generator 1070 as discussed above.

In some alternative embodiments the generator 1070 is arranged to introduce swirl in liquid entering the generator 1070. For example, flow deflectors may be provided around the injector 1078 or other portion such as an inner wall of the generator 1070 to induce swirl in liquid L1 entering the generator 1070.

Figure 17:
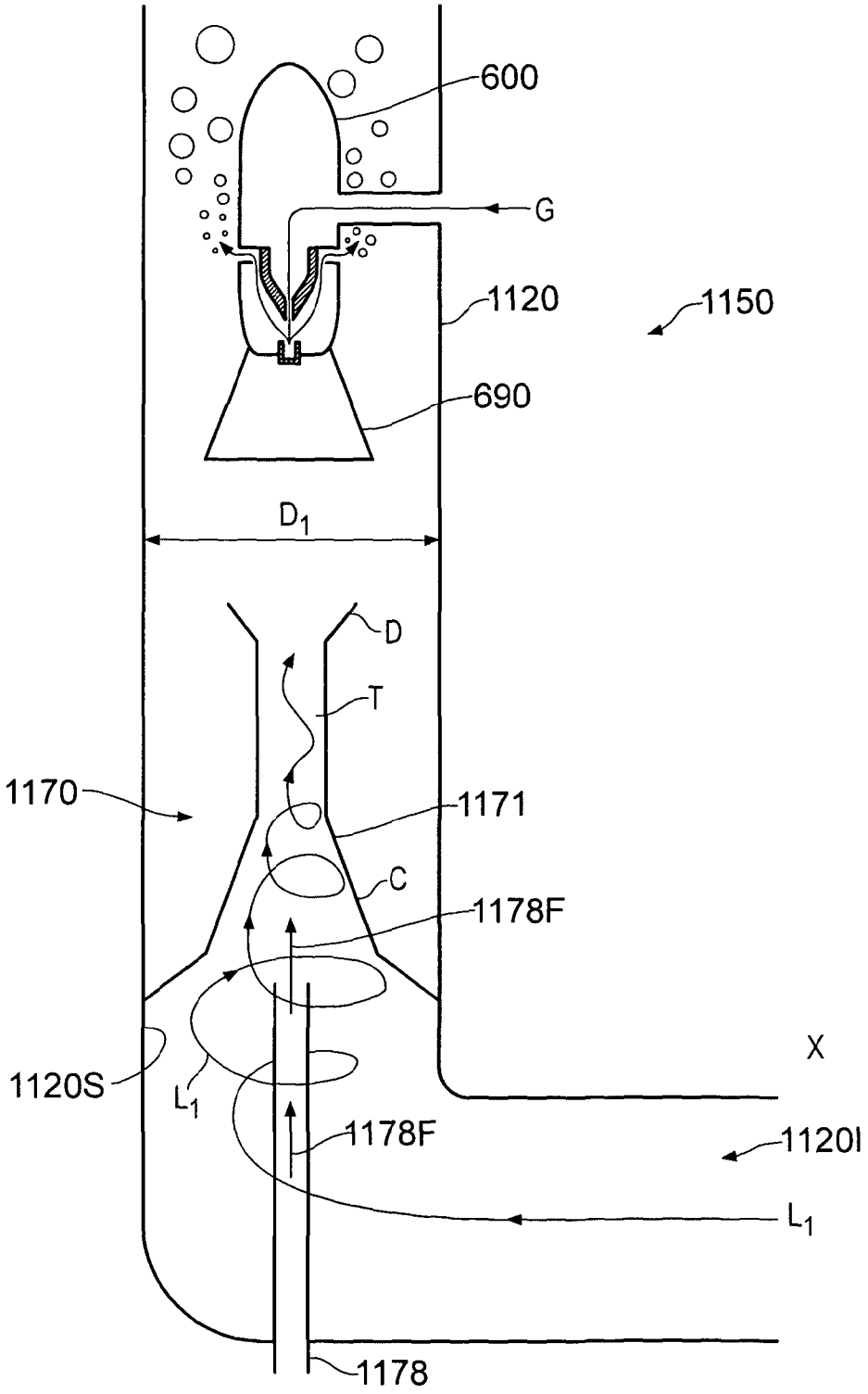
FIG. 17 shows gas lift pump apparatus according to a still further embodiment of the invention having the fluid delivery device of the embodiment of FIG. 10.

FIG. 17 is a schematic illustration of gas lift pump apparatus 1150 according to a further embodiment of the invention. Like features of the apparatus of FIG. 17 to those of the apparatus of FIG. 15 are labelled with like reference signs prefixed '11' instead of numeral 9.

The embodiment of FIG. 17 is similar to that of FIG. 16 in that the microbubble generator does not have a separate liquid injector, unlike the generator 970 of FIG. 15. Furthermore the column 1120 is substantially J-shaped and has an inlet 1120I at an end of the column 920 being a lowermost end.

The generator 1170 of the apparatus 1150 of FIG. 17 is similar to that of the embodiment of FIG. 13 in that substantially all liquid $L_1$ entering the column (at the single liquid inlet 1020I) passes through the generator 1170. That is, none (or substantially none) of the liquid $L_1$ passing through the inlet 1120I passes around the generator 1170, but rather passes through the venturi portion defined by the generator 1170.

The apparatus 1150 is again arranged to induce swirl of the liquid $L_1$ entering the column 1120 so as to encourage the formation of microbubbles by intimate mixing of the gas flow 1178F injected upstream of the generator 1170 and liquid $L_1$.

In some embodiments having the arrangement of FIG. 16 or FIG. 17, swirl of the liquid $L_1$ is induced by introducing the flow of liquid $L_1$ into the vertical portion of the column 1020, 1120 along a direction tangential to an inner surface 1020S, 1120S of the column 1020, 1120. Other arrangements are also useful. For example guide elements such as vanes or other elements arranged to induce rotational motion of the fluid within the column 1020, 1120 may also be provided.

Other arrangements are also useful.

Reference herein to a vessel includes reference to any boat, ship or other floating structure having at least one ballast tank in the form of a liquid storage tank.

Embodiments of the present invention may be understood by reference to the following numbered paragraphs:

1. A fluid delivery device for delivering a flow of a gaseous fluid into a liquid medium, the device comprising means for generating ultrasonic energy therein under the flow of gaseous fluid therethrough, the device being operable to launch the ultrasonic energy into the liquid medium.

2. A device as described in paragraph 1 wherein the means for generating ultrasonic energy comprises a resonance chamber, the device being operable to excite the resonance chamber at a resonant frequency of the apparatus due to flow of the gaseous fluid through the device thereby to launch the ultrasonic energy.

3. A device as described in paragraph 2 wherein the resonance chamber is provided with a receptor member, the receptor member being arranged to receive and deflect a flow of the gaseous fluid thereby to generate pressure waves in the gaseous fluid.

4. A device as described in paragraph 3 wherein the receptor member is provided by at least a portion of a wall of the resonance chamber.

5. A device as described in paragraph 3 or paragraph 4 wherein the receptor member is provided by a member within the resonance chamber.

6. A device as described in any one of paragraphs 2 to 5 operable to cause the gaseous fluid to pass into the resonance chamber thereby to excite resonance of the resonance chamber.

7. A device as described in paragraph 3 or paragraph 4 wherein the receptor member is provided on an outside of the resonance chamber.

8. A device as described in paragraph 3 or any one of paragraphs 4 to 7 depending through paragraph 3 wherein the receptor member comprises a cupped portion, the device being arranged to direct a flow of gaseous fluid into the cupped portion of the receptor member, the receptor member being arranged in turn to redirect the flow of gaseous fluid out from the cupped portion.

9. A device as described in paragraph 3 or any one of paragraphs 4 to 8 depending through paragraph 3 operable wherein impingement of gaseous fluid on the receptor member causes heating of the receptor member.

10. A device as described in paragraph 9 operable wherein heating of the receptor member is arranged to cause heating of the liquid medium.

11. A device as described in paragraph 3 or any one of paragraphs 4 to 10 depending through paragraph 3 wherein the receptor member is in thermal communication with a surface of the device that is in turn in thermal communication with the liquid medium.

12. A device as described in paragraph 3 or any one of paragraphs 4 to 11 depending through paragraph 3 comprising a nozzle member, the nozzle member being arranged to deliver the flow of gaseous fluid into the receptor member.

13. A device as described in paragraph 12 operable to cause an ultrasonic standing wave to be established between the nozzle member and the receptor member.

14. A device as described in any preceding paragraph operable to change a resonant frequency of the device from a first value to a second value.

15. A device as described in paragraph 14 depending through paragraph 3 operable to change the resonant frequency of the device by changing a position of the receptor member.

16. A device as described in paragraph 15 depending through paragraph 12 operable to change the resonant frequency of the device by changing a position of the receptor member with respect to the nozzle member.

17. A device as described in any preceding paragraph provided with amplification means for increasing an amplitude of the ultrasonic energy launched into the medium.

18. A device as described in paragraph 17 wherein the amplification means comprises means for reducing a mismatch between an impedance of the device and an impedance of the liquid medium.

19. A device as described in paragraph 17 or 18 wherein the amplification means comprises an amplification chamber, the amplification chamber being acoustically coupled to the device.

20. A device as described in paragraph 19 wherein the amplification chamber comprises a gas filled chamber.

21. A device as described in paragraph 19 or 20 wherein the amplification chamber has a cross-sectional area that increases as a function of distance from the device.

22. A device as described in any one of paragraphs 19 to 21 wherein the amplification chamber has a substantially tapered cross-section.

23. A device as described in any one of paragraphs 19 to 22 wherein the amplification chamber has a substantially conical shape.

24. A device as described in any one of paragraphs 19 to 23 wherein the amplification chamber has a substantially frusto-conical shape.

25. A device as described in any one of paragraphs 19 to 24 wherein at least one wall of the chamber comprises a resiliently flexible membrane arranged to transmit at least a portion of the ultrasonic energy into the liquid medium.

26. A device as described in paragraph 25 wherein the resiliently flexible membrane comprises at least one selected from amongst a metallic material and a polymer.

27. A device as described in any preceding paragraph arranged to be provided in a flowstream of the liquid medium, the device having an upstream portion and a downstream portion.

28. A device as described in paragraph 27 wherein the downstream portion is tapered thereby to reduce an amount of drag experienced by the device in the flowstream.

29. A device as described in paragraph 27 or 28 depending through paragraph 3 wherein the receptor member is provided upstream of a downstream portion of the device.

30. A device as described in any one of paragraphs 27 to 29 depending through paragraph 17 wherein the amplification means is arranged to direct the ultrasonic energy away from the downstream portion.

31. A device as described in any one of paragraphs 27 to 30 depending through paragraph 17 wherein the amplification means is provided upstream of the downstream portion.

32. A device as described in paragraph 27 or any one of paragraphs 28 to 31 depending through paragraph 27 wherein the resonance chamber is arranged to contain the liquid medium.

33. A device as described in paragraph 32 wherein the resonance chamber is arranged to provide a conduit for flow of the liquid medium therethrough.

34. A device as described in any preceding paragraph operable to kill aquatic nuisance species in the liquid medium by means of the ultrasonic energy.

35. A device as described in any preceding paragraph wherein an aperture is provided through which gaseous fluid passes from the device into the liquid medium, the device being operable to generate ultrasonic energy by passage of the gaseous fluid through the aperture.

36. Apparatus comprising a device as described in any preceding paragraph in combination with a microbubble generator, the microbubble generator being arranged to generate microbubbles of gas in the liquid medium, the apparatus being operable to direct a flow of microbubbles entrained in the liquid medium towards the device.

37. Apparatus as described in paragraph 36 wherein the microbubble generator is arranged to generate microbubbles upstream of the device.

38. Apparatus as described in paragraph 36 or 37 wherein the generator comprises a venturi portion through which the liquid medium is forced to flow, the venturi portion having a converging section, a throat section and a diverging section.

39. Apparatus as described in any one of paragraphs 36 to 38 arranged to provide a flow of the liquid medium into the venturi in the form of a vortex thereby to generate microbubbles in the liquid medium.

40. Apparatus as described in any one of paragraphs 36 to 39 arranged to generate a flow of liquid medium into the venturi in the form of a vortex by injecting a flow of liquid medium into the column of the apparatus.

41. Apparatus as described in any one of paragraphs 36 to 40 arranged to generate a flow of liquid medium into the venturi in the form of a vortex by injecting a flow of liquid medium into the column of the apparatus in a direction substantially tangential to an inner surface of the column.

42. Apparatus as described in any one of paragraphs 36 to 41 arranged to generate microbubbles having a diameter in the range of at least one selected from amongst from around 1 micron to around 1000 microns, around 1 micron to around 500 microns, around 1 micron to around 100 microns, around 1 micron to around 10 microns and around 10 microns to around 100 microns, 43. Apparatus as described in any one of paragraphs 36 to 42 provided in a column of gas lift pump apparatus comprising a column through which liquid may be pumped by gas lift.

44. Apparatus as described in paragraph 43 wherein gaseous fluid flowing through the fluid delivery device is arranged to pass into the column of the gas lift pump apparatus thereby to cause pumping of the liquid medium.

45. Apparatus as described in any one of paragraphs 36 to 44 operable to kill ANS present in the liquid by means of the ultrasonic energy generated by the device.

46. Gas lift pump apparatus comprising a column through which liquid is pumped by gas lift, the apparatus comprising a device as described in any one of paragraphs 1 to 35.

47. Apparatus as described in paragraph 46 wherein gaseous fluid flowing through the fluid delivery device is arranged to pass into the column of the gas lift pump apparatus thereby to cause pumping of the liquid medium.

48. Apparatus as described in paragraph 46 or 47 operable to kill ANS present in the liquid by means of the ultrasonic energy generated by the device.

49. A method of delivering gaseous fluid into a liquid medium comprising the steps of:

providing a flow of the gaseous fluid through a fluid delivery device, the device being arranged whereby the flow of gaseous fluid through the device causes the device to launch ultrasonic energy into the liquid medium.

50. A method as described in paragraph 49 wherein the gaseous fluid is selected whereby increasing a concentration of the gaseous fluid in the liquid medium to a sufficiently high value results in death of at least one ANS present in the liquid medium.

51. A method as described in paragraph 49 or 50 wherein the gaseous fluid is selected whereby increasing a concentration of said gaseous fluid in the liquid medium to a sufficiently high value results in a decrease in a concentration of a further component of the liquid thereby to cause death of at least one ANS present in the liquid medium.

52. A method as described in any one of paragraphs 49 to 51 wherein the gaseous fluid comprises an inert gas.

53. A method as described in any one of paragraphs 49 to 52 wherein the gaseous fluid comprises at least one selected from amongst carbon dioxide, nitrogen and oxygen.

54. A method as described in any one of paragraphs 49 to 53 wherein the gaseous fluid substantially comprises carbon dioxide, nitrogen and oxygen.

55. A method as described in any one of paragraphs 49 to 54 wherein the gaseous fluid consists essentially of carbon dioxide, nitrogen and oxygen.

56. A method as described in any one of paragraphs 49 to 53 wherein the gaseous fluid is carbon dioxide.

57. A method as described in any one of paragraphs 49 to 55 wherein the gaseous fluid comprises combustion gases.

58. A method as described in any one of paragraphs 49 to 57 wherein the liquid medium is ballast water of a vessel.

59. A method as described in any one of paragraphs 49 to 58 wherein the liquid medium is ballast water in a ballast tank of a vessel.

60. A method as described in any one of paragraphs 49 to 59 comprising generating ultrasonic energy by passage of gaseous fluid through an aperture from the device into the liquid medium.

61. A method as described in any one of paragraphs 49 to 60 further comprising producing microbubbles of gaseous fluid in the liquid medium and launching the ultrasonic energy into the liquid medium containing the microbubbles.

62. A method as described in paragraph 61 comprising the step of trapping ANS present in the liquid medium in or on a microbubble.

63. A method as described in paragraph 62 comprising killing the ANS by means of the ultrasonic energy.

64. A method as described in any one of paragraphs 61 to 63 comprising the step of generating microbubbles of gaseous fluid in the liquid medium, the microbubbles having a diameter in the range of at least one selected from amongst from around 1 micron to around 1000 microns, around 1 micron to around 500 microns, around 1 micron to around 100 microns, around 1 micron to around 10 microns and around 10 microns to around 100 microns, 65. A method as described in any one of paragraphs 49 to 64 comprising the step of pumping the liquid medium through a column of a gas lift pump by means of gas lift and launching ultrasonic energy into the liquid medium within the column.

66. A method of killing aquatic nuisance species (ANS) comprising the steps of:

providing a flow of a gaseous fluid through a fluid delivery device, the device being arranged wherein the flow of gaseous fluid through the device causes the device to launch ultrasonic energy into the liquid medium thereby to kill ANS therein, the method comprising killing ANS by means of the ultrasonic energy.

67. A method as described in paragraph 66 wherein the gaseous fluid comprises an inert gas.

68. A method as described in paragraph 66 or 67 wherein the gaseous fluid comprises at least one selected from amongst carbon dioxide, nitrogen and oxygen.

69. A method as described in any one of paragraphs 66 to 68 wherein the gaseous fluid substantially comprises carbon dioxide, nitrogen and oxygen.

70. A method as described in any one of paragraphs 66 to 69 wherein the gaseous fluid consists essentially of carbon dioxide, nitrogen and oxygen.

71. A method as described in any one of paragraphs 66 to 68 wherein the gaseous fluid is carbon dioxide.

72. A method as described in any one of paragraphs 66 to 71 wherein the gaseous fluid is selected whereby increasing a concentration of the gaseous fluid in the liquid medium causes death of aquatic nuisance species.

73. A method as described in paragraph 72 whereby increasing a concentration of the gaseous fluid in the liquid medium causes a reduction in a concentration of at least one chemical species in the liquid medium.

74. A method as described in any one of paragraphs 66 to 73 comprising generating ultrasonic energy by passage of gaseous fluid through an aperture from the device into the liquid medium.

75. A method as described in any one of paragraphs 66 to 74 further comprising producing microbubbles in the liquid medium and launching the ultrasonic energy into the liquid medium containing the microbubbles.

76. A method as described in paragraph 75 comprising trapping ANS present in the liquid medium in or on a microbubble.

77. A method as described in paragraph 76 comprising killing the ANS by means of the ultrasonic energy.

78. A liquid storage tank comprising a device as described in any one of paragraphs 1 to 35.

79. A ballast tank for a marine vessel comprising a device as described in any one of paragraphs 1 to 35.

80. A vessel having a ballast tank comprising a device as described in any one of paragraphs 1 to 35.

81. A liquid storage tank comprising apparatus as described in any one of paragraphs 36 to 48.

82. A ballast tank for a marine vessel comprising apparatus as described in any one of paragraphs 36 to 48.

83. A vessel having a ballast tank comprising apparatus as described in any one of paragraphs 36 to 48.

Embodiments of the invention may also be understood with reference to the following numbered paragraphs:

1. A fluid delivery device for delivering a flow of a gaseous fluid into a liquid medium, the device comprising means for generating ultrasonic energy therein under the flow of gaseous fluid therethrough, the device being operable to launch the ultrasonic energy into the liquid medium, wherein at the nozzle exit the high velocity air (~300 m/sec) forms a jet into the Resonance Chamber.

2. A fluid delivery device for delivering a flow of a gaseous fluid into a liquid medium, the device comprising means for generating ultrasonic energy therein under the flow of gaseous fluid therethrough, the device being operable to launch the ultrasonic energy into the liquid medium, wherein the distance between the Nozzle tip and the Resonance Chamber sets the frequency generated.

3. A fluid delivery device for delivering a flow of a gaseous fluid into a liquid medium, the device comprising means for generating ultrasonic energy therein under the flow of gaseous fluid therethrough, the device being operable to launch the ultrasonic energy into the liquid medium, wherein as the Ultrasonic Energy is produced in air, at a pre-determined specific frequency it is then easily transferred into the water surrounding the device.

4. A fluid delivery device for delivering a flow of a gaseous fluid into a liquid medium, the device comprising means for generating ultrasonic energy therein under the flow of gaseous fluid therethrough, the device being operable to launch the ultrasonic energy into the liquid medium, wherein the excess air is vented to avoid over pressurising the device.

5. A fluid delivery device for delivering a flow of a gaseous fluid into a liquid medium, the device comprising means for generating ultrasonic energy therein under the flow of gaseous fluid therethrough, the device being operable to launch the ultrasonic energy into the liquid medium, wherein the Ultrasonic Energy that is produced is tunable to the most effective frequency.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

KEY

100E: Ultrasonic Energy

The invention claimed is:

1. A system, comprising:

a ballast tank for a marine vessel, the ballast tank containing a liquid; and a gas lift pump apparatus comprising:

a hollow tube member mounted in a substantially upright orientation within the ballast tank and at least partially submerged within the liquid in the ballast tank, wherein the hollow tube member comprises a liquid inlet and a liquid outlet arranged such that the liquid in the ballast tank can flow upwardly through the hollow tube member and thereby circulate within the ballast tank, wherein the liquid in the ballast tank recirculates within the ballast tank from the liquid outlet of the hollow tube member to the liquid inlet of the hollow tube member;

a fluid delivery device within the hollow tube member, the fluid delivery device comprising a resonance chamber; and a conduit extending from the fluid delivery device to a gas supply external to the ballast tank, wherein the resonance chamber generates ultrasonic energy therein by a flow of gas via the conduit through the resonance chamber, wherein the fluid delivery device launches the ultrasonic energy into the liquid in the hollow tube member, wherein the ultrasonic energy kills aquatic nuisance species (ANS) present in the liquid;

wherein the flow of gas through the resonance chamber causes pumping of the liquid upwardly through the hollow tube member and recirculation of the liquid within the ballast tank.

2. The system of claim 1, wherein the hollow tube member comprises at least one aperture in a wall thereof to allow the liquid to flow out from the hollow tube member during the recirculation of the liquid within the ballast tank.

3. The system of claim 1, wherein the resonance chamber comprises a receptor member that is configured to receive and deflect the flow of the gas to generate pressure waves in the gas.

4. The system of claim 3, wherein the receptor member comprises a cupped portion, the fluid delivery device being arranged to direct the flow of gas into the cupped portion of the receptor member, the receptor member being arranged in turn to redirect the flow of gas out from the cupped portion, the gas lift pump apparatus comprising a nozzle member, the nozzle member being arranged to deliver the flow of gas into the receptor member.

5. The system of claim 4, operable to change a resonant frequency of the fluid delivery device from a first value to a second value, optionally the gas lift pump apparatus being operable to change the resonant frequency of the fluid delivery device by changing a position of the receptor member with respect to the nozzle member.

6. The system of claim 1, further comprising an amplification chamber configured to increase an amplitude of the ultrasonic energy launched into the liquid, wherein the amplification chamber is acoustically coupled to the fluid delivery device, and wherein the amplification chamber comprises a gas filled chamber.

7. The system of claim 1, wherein the fluid delivery device is arranged to be provided in a flowstream of the liquid through the hollow tube member, the fluid delivery device having an upstream portion and a downstream portion.

8. The system of claim 1, further comprising a microbubble generator configured to generate microbubbles of gas in the liquid, and to direct a flow of the microbubbles entrained in the liquid towards the fluid delivery device.

9. The system of claim 8, wherein the microbubble generator is arranged to generate the microbubbles upstream of the fluid delivery device, wherein the microbubble generator is arranged to deliver the microbubbles within the hollow tube member.

10. The system of claim 8, wherein the microbubble generator comprises a venturi portion through which the liquid is forced to flow, the venturi portion having a converging section, a throat section and a diverging section.

11. The system of claim 10, arranged to provide a flow of the liquid into the venturi portion in the form of a vortex thereby to generate the microbubbles in the liquid.

12. The system of claim 1, wherein the gas supplied by the gas supply is carbon dioxide.

* * * * *